US008096079B2

(12) United States Patent
Zajk

(10) Patent No.: US 8,096,079 B2
(45) Date of Patent: Jan. 17, 2012

(54) REVOLVER TRIGGER MECHANISM

(75) Inventor: Joseph J. Zajk, Newport, NH (US)

(73) Assignee: Sturm, Ruger & Company, Inc., Southport, CT (US)

( * ) Notice: Subject to any disclaimer, the term of this patent is extended or adjusted under 35 U.S.C. 154(b) by 615 days.

(21) Appl. No.: 12/184,376

(22) Filed: Aug. 1, 2008

(65) Prior Publication Data

US 2009/0044437 A1 Feb. 19, 2009

Related U.S. Application Data

(60) Provisional application No. 60/955,723, filed on Aug. 14, 2007.

(51) Int. Cl.
*F41A 19/00* (2006.01)

(52) U.S. Cl. ..... 49/65

(58) Field of Classification Search ..... 42/65, 69.01, 42/64, 42.01, 42.03, 41, 69.03, 42.02, 59
See application file for complete search history.

(56) References Cited

U.S. PATENT DOCUMENTS

| | | | | |
|---|---|---|---|---|
| 2,945,316 | A * | 7/1960 | Mulno | 42/66 |
| 3,177,602 | A | 4/1965 | Geber | |
| 3,662,483 | A | 5/1972 | Seecamp | |
| 4,023,465 | A | 5/1977 | Inskip | |
| 4,028,835 | A | 6/1977 | Canjar | |
| 4,067,131 | A | 1/1978 | Ruger et al. | |
| 4,138,789 | A | 2/1979 | Langsford | |
| 4,151,670 | A | 5/1979 | Rath | |
| 4,307,530 | A | 12/1981 | Mechor et al. | |
| 4,522,106 | A | 6/1985 | Sullivan | |
| 4,621,445 | A | 11/1986 | Rohm | |
| 4,658,702 | A | 4/1987 | Tatro | |
| 4,680,884 | A | 7/1987 | Smith | |
| 4,918,850 | A | 4/1990 | Rick | |
| 5,115,588 | A | 5/1992 | Bronsart et al. | |
| 5,274,939 | A | 1/1994 | Scaramucci et al. | |

(Continued)

FOREIGN PATENT DOCUMENTS

DE 296 07 415 U1 8/1997

OTHER PUBLICATIONS

European Search Report dated Jan. 25, 2011 in corresponding application EP 08 79 7345.9.

(Continued)

*Primary Examiner* — Bret Hayes
*Assistant Examiner* — Reginald Tillman, Jr.
(74) *Attorney, Agent, or Firm* — Duane Morris LLP; Frank J. Spanitz

(57) ABSTRACT

A revolver with trigger mechanism for cocking a rotatable hammer. The revolver includes a frame, a barrel supported by the frame and defining a bore, at least one chamber aligned with the bore of barrel for holding a cartridge, a hammer pivotally mounted to the frame and moveable between a forward uncocked position and a rearward cocked position, and a trigger pivotally mounted to the frame. In one embodiment, the trigger includes a contoured camming surface configured and arranged to engage a protrusion extending outwards from the hammer for cocking the hammer in response to pulling the trigger. The protrusion may be a hammer dog pivotally coupled to the hammer in some embodiments. In another embodiment, the hammer may include a sear having a contoured camming surface for engaging the trigger.

26 Claims, 14 Drawing Sheets

U.S. PATENT DOCUMENTS

| | | | | |
|---|---|---|---|---|
| 5,501,134 | A | 3/1996 | Milazzo et al. | |
| 5,548,914 | A * | 8/1996 | Anderson | 42/66 |
| 5,623,114 | A | 4/1997 | Soper | |
| 5,635,664 | A | 6/1997 | Pons et al. | |
| 5,680,722 | A | 10/1997 | French et al. | |
| 5,881,485 | A | 3/1999 | Milazzo | |
| 6,131,324 | A | 10/2000 | Jewell | |
| 6,385,888 | B1 | 5/2002 | Power | |
| 6,615,527 | B1 | 9/2003 | Martin | |
| 6,681,511 | B1 | 1/2004 | Huber | |
| 6,772,548 | B1 | 8/2004 | Power | |
| 6,928,763 | B2 | 8/2005 | Zajk | |
| 7,150,121 | B1 * | 12/2006 | Clay | 42/69.01 |
| 7,243,452 | B2 | 7/2007 | Zeh | |
| 2003/0172571 | A1 | 9/2003 | West | |
| 2006/0123685 | A1 | 6/2006 | Zeh | |

OTHER PUBLICATIONS

Corresponding English Translation of Office Action and Search Report of the IPO of ROC (Taiwan) issued in Taiwanese Patent Application No. 097131016, on Aug. 18, 2011, pp. 1-9.

* cited by examiner

REVOLVER TRIGGER MECHANISM

CROSS-REFERENCE TO RELATED APPLICATIONS

The present application claims priority to U.S. Provisional Application No. 60/955,723 filed Aug. 14, 2007, which is incorporated herein by reference in its entirety.

BACKGROUND OF THE INVENTION

The present invention generally relates to firearms, and more particularly to firing control mechanisms for revolvers having trigger-actuated cockable hammers.

Conventional revolvers generally include a frame which supports a rotatable cylinder having a plurality of chambers adapted for holding cartridges, a barrel, and a firing control mechanism including a hammer and a trigger pivotally mounted to the frame for operating the hammer. In double-action revolvers, the trigger is operable via a single continuous rearward pull by the user that both fully cocks and then releases the hammer to discharge the revolver.

Conventional trigger designs are generally described in U.S. Pat. Nos. 3,628,278 and 4,307,530, which are each incorporated herein by reference in their entireties. FIG. 5 of U.S. Pat. No. 3,628,278 is reproduced herein as FIG. 1. The trigger 7 is pivotally mounted to the revolver frame about a pivot pin 39. The trigger includes a rear operating extension 42 that projects in a rearward direction towards the pivotally mounted hammer 6. A trigger spring (not shown) biases the trigger forward in a clockwise direction (as viewed in FIG. 1). A spring-loaded lever, generally referred to as a hammer dog 36, is pivotally mounted to the hammer for cocking the hammer. The hammer dog 36 is engaged by rear operating extension 42 of the trigger. Pulling the trigger 7 rearward causes the trigger and operating extension to rotate in a counterclockwise direction, which engages and rotates the hammer dog 36 in a clockwise direction. This concomitantly rotates the hammer 6 clockwise against the forward biasing force of the hammer mainspring 32. The hammer eventually reaches a fully cocked rearward position, and is then released by the trigger. The hammer rotates forward in a counterclockwise direction to in turn contact and drive a firing pin 35 forward which strikes and detonates a chambered cartridge.

When firing a double action revolver, the user must apply sufficient finger pull pressure to the trigger to overcome at least the forward biasing effect of both the trigger spring and the hammer main spring. In addition, friction between mating surfaces on the rear operating extension of the trigger and the hammer dog must be overcome by the trigger pull. Due to the operational interaction and geometrical arrangement between the meshing surfaces of the trigger and hammer dog used heretofore, trigger action in conventional revolver firing control mechanisms has generally been characterized by uneven trigger pull resistance over the trigger's full range of motion. As shown in the graph in FIG. 2, conventional known trigger mechanisms typically require initially higher peak or maximum trigger pull pressure or force by the user during the first portion of rearward range of motion of the trigger. The trigger pull pressure or force requirements then level off followed by a sometimes sharp or abrupt decrease in magnitude as the trigger is continued to be pulled fully rearward by the user through hammer release. This phenomenon causes the revolver to jump or jerk momentarily, which may make it more difficult for some users to steady the firearm and keep it aimed precisely on target down range. In addition, the generally high peak trigger pull force requirements and non-uniform pull force give conventional double action revolver trigger mechanisms their characteristically heavy trigger pull, which may make using such revolvers more cumbersome for some users.

An improved firearm trigger mechanism is therefore desired.

SUMMARY OF THE INVENTION

The present invention provides a specially configured or profiled trigger that reduces the shortcomings of foregoing conventional trigger designs. Unlike conventional triggers, as further described herein, the operating surface of the trigger according to the present invention in one embodiment is configured and arranged to make contact with the hammer dog in a manner such that the force applied to the hammer dog by the trigger acts in a line of action that is tangent to the circular or arcuate paths of motion of the hammer and trigger to provide maximum mechanical advantage. This embodiment minimizes the initial trigger stall or binding found in conventional trigger designs, and provides a more uniform, smooth trigger pull throughout the trigger's entire range of motion while minimizing the peak or maximum pressure/force required to pull the trigger. According to another aspect of the present invention, a hammer is provided that includes a sear having a contoured operating surface that engages the trigger and provides smoother trigger pull characteristics than conventional trigger designs.

In one embodiment of the present invention, a revolver with trigger mechanism includes: a frame; a barrel supported by the frame and defining a bore; at least one rotatable chamber aligned with the bore of barrel for holding a cartridge; a hammer pivotally mounted in the frame and moveable between a forward uncocked position and a rearward cocked position; and a trigger pivotally mounted to the frame and operable to cock the hammer. The trigger includes a concave camming surface configured and arranged to engage and cock the hammer in response to pulling the trigger. In some embodiments, the concave camming surface engages a hammer dog pivotally coupled to the hammer. In another embodiment, the trigger further includes a convex camming surface being configured and arranged to engage the hammer in response to pulling the trigger.

According to another embodiment, a revolver with trigger mechanism includes: a cylinder rotatably mounted in a frame and defining a plurality of chambers for holding cartridges; a hammer pivotally mounted to the revolver and moveable between a forward uncocked position and a rearward cocked position; a hammer dog coupled to the hammer for cocking the hammer; and a trigger pivotally mounted to the revolver and operable to cock the hammer. The trigger includes a concave camming surface configured and arranged to engage the hammer dog, wherein the concave camming surface engages the hammer dog and cocks the hammer in response to pulling the trigger. In one embodiment, pulling the trigger slides the hammer dog along the trigger from the concave camming surface to a convex camming surface. In other embodiments, the trigger includes a hammer engaging ledge that engages a convex camming surface disposed on a lower operating surface of the hammer. In some embodiments, the lower operating surface is disposed on a forward-extending sear defined by the hammer.

In another embodiment, a revolver with trigger mechanism includes: a cylinder rotatably mounted in a frame and defining a plurality of chambers for holding cartridges; a hammer pivotally mounted to the revolver and rotatable along a first arcuate path of motion between a rearward cocked position and a forward uncocked position; a hammer dog coupled to the hammer and defining a contact surface; and a trigger pivotally mounted to the revolver and rotatable along a second arcuate path of motion. The trigger includes a concave camming surface that engages the contact surface of the hammer dog in response to pulling the trigger. Preferably, the concave camming surface of the trigger and the contact surface of the hammer dog are mutually configured and arranged such that the normal contact forces resulting between the trigger and hammer dog act in a line of action that is substantially tangent to both the first and second paths of motion during at least part of a sequence of pulling the trigger.

According to another embodiment, a revolver with trigger mechanism includes: a cylinder rotatably mounted in a frame and defining a plurality of chambers for holding cartridges; a hammer pivotally mounted to the revolver and moveable between a forward uncocked position and a rearward cocked position; a hammer dog coupled to the hammer for cocking the hammer; a trigger pivotally mounted to the revolver and operable to cock the hammer, the trigger including a concave camming surface configured and arranged to engage the hammer dog; and a sear defined by a portion of the hammer and having a non-planar contoured lower operating surface engageable with the trigger. Rotating the trigger to a first position engages the concave camming surface with the hammer dog and partially cocks the hammer. In some embodiments, the non-planar contoured lower operating surface of the sear includes radiused portions. In one embodiment, the contoured lower operating surface of the sear may include a convex camming surface engageable with the trigger, and may further include a concave camming surface engageable with the trigger in other embodiments. In one embodiment, the trigger further includes a convex camming surface disposed adjacent to the concave camming surface of the trigger. The convex camming surface of the trigger is preferably configured and arranged on the trigger to engage the hammer dog. In some embodiments, rotating the trigger to a second position engages a convex camming surface disposed on the trigger with the hammer dog and further cocks the hammer. In another embodiment, rotating the trigger to the second position simultaneously engages a convex camming surface on the lower operating surface of the sear with the trigger. In one embodiment, the convex camming surface on the lower operating surface of the sear engages a hammer engaging ledge disposed on the trigger. In some embodiments, the hammer engaging ledge is spaced apart from the concave camming surface of the trigger.

A method for cocking a hammer in revolver is also provided. In one embodiment, the method includes: providing a firearm having a firing control mechanism including a pivotally mounted hammer and a trigger; rotating the trigger; moving a concave camming surface on the trigger towards the hammer; and cocking the hammer with the concave camming surface of the trigger. In one embodiment, the method further includes engaging the concave camming surface with a protrusion extending outwards from the hammer. In some embodiments, the protrusion may be a spring-loaded hammer dog pivotably coupled to the hammer. In one embodiment, the method further includes engaging a convex camming surface on the trigger with the protrusion in response to rotating the trigger. In another embodiment, the method further includes applying a normal force with the concave camming surface on a protrusion extending outwards from the hammer that acts along a line of action that is tangent to both an arcuate path of motion defined by the hammer and an arcuate path of motion defined by the trigger. In yet another embodiment, the cocking step includes first engaging the concave camming surface with a protrusion extending outwards from the hammer and subsequently engaging a convex camming surface on the trigger with the protrusion extending outwards from the hammer. In another embodiment, the method further includes engaging a convex camming surface formed on a lower surface of the hammer with a hammer engaging ledge formed on the trigger.

BRIEF DESCRIPTION OF THE DRAWINGS

The features of the preferred embodiments will be described with reference to the following drawings where like elements are labeled similarly, and in which.

DESCRIPTION OF PREFERRED EMBODIMENTS

Figure 1:
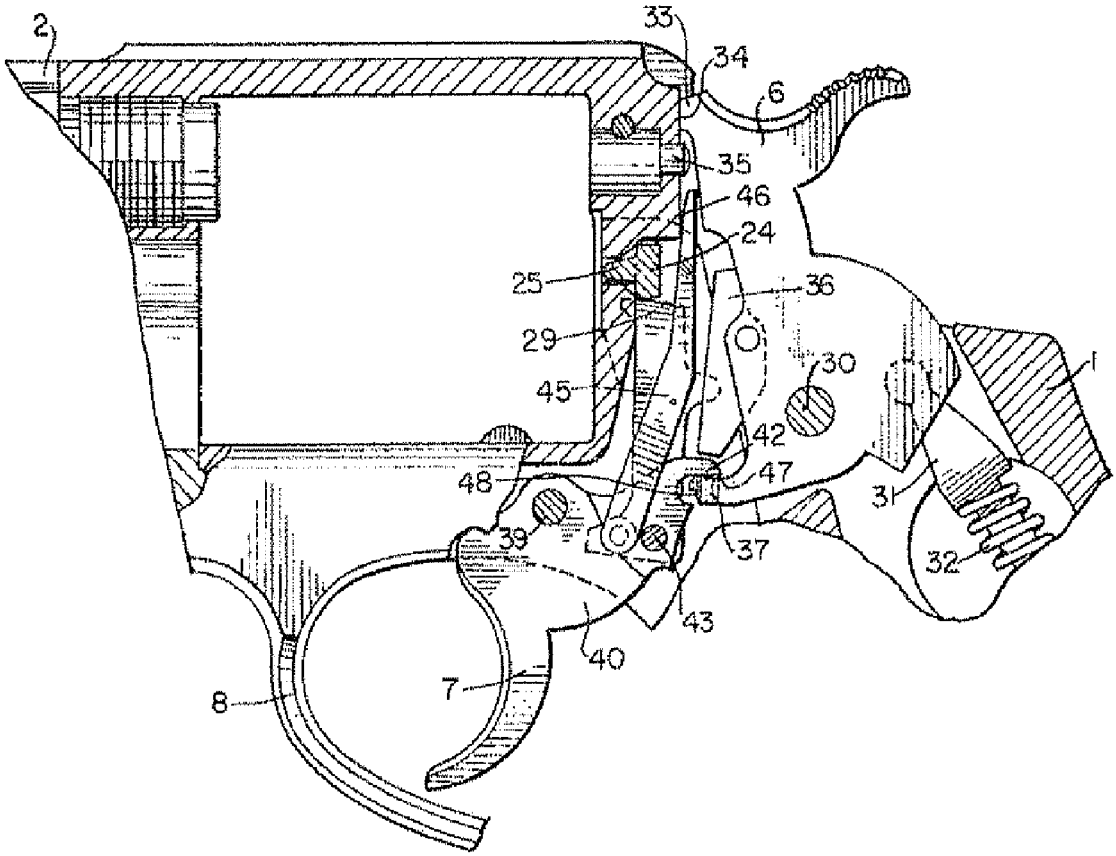
FIG. 1 (PRIOR ART)
FIG. 1 is a left side partial cross-sectional view of a prior art trigger-hammer mechanism for a revolver.

The features and benefits of the invention are illustrated and described herein by reference to preferred embodiments. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected" and "interconnected," refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

As used herein, the term "revolver" may refer to any type of firearm or weapon, such as for example a handgun or pistol, rifle, grenade launcher, etc. that includes at least one barrel and multiple rotationally-mounted chambers for holding ammunition cartridges.

Figure 3:
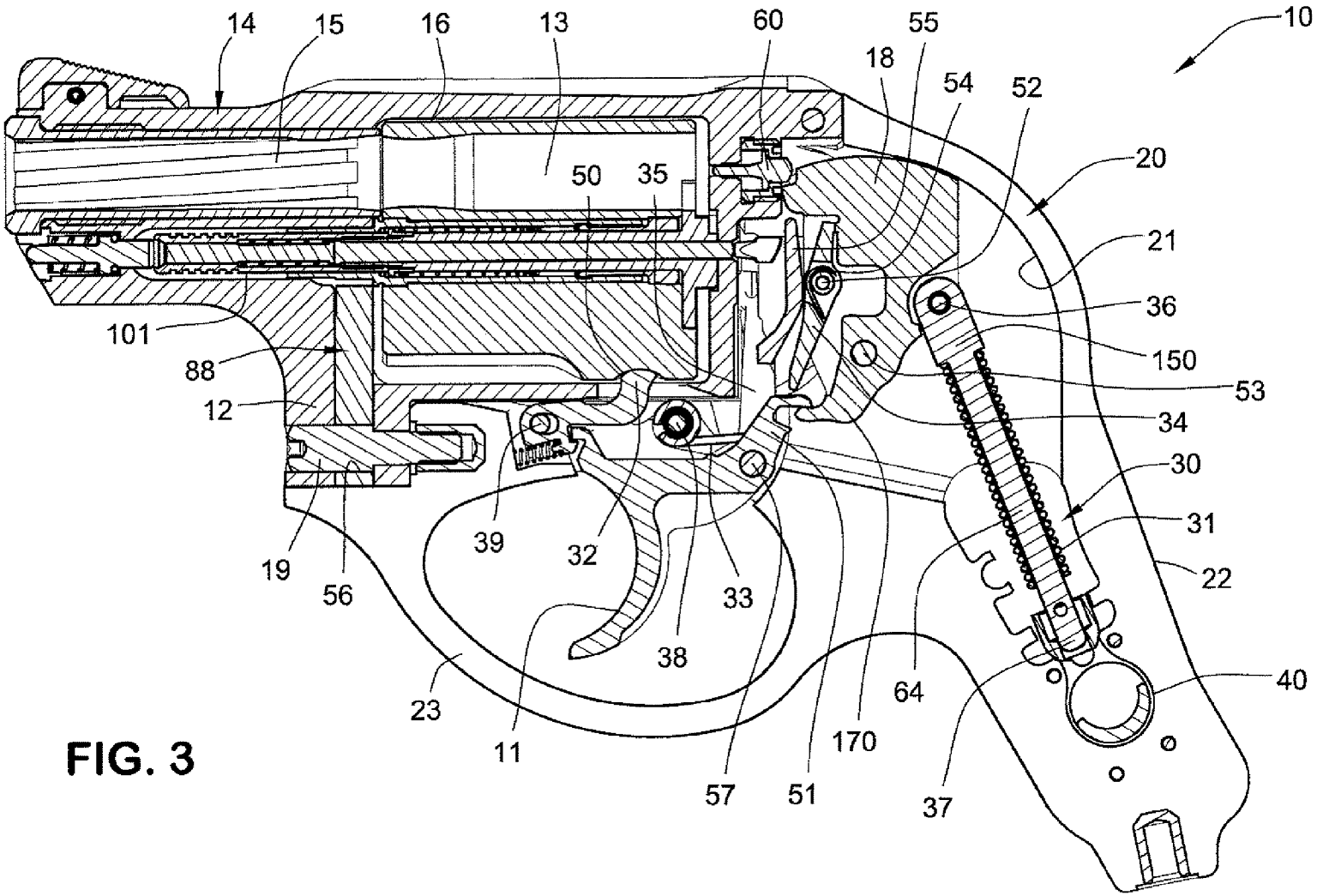
FIGS. 3 is a left side cross-sectional view of one embodiment of a revolver according to the present invention with the trigger-hammer mechanism in a standby condition prior to trigger actuation with the hammer forward and uncocked.

Referring to FIG. 3, one preferred embodiment of a revolver 10 according to principles of the present invention is shown in the form of a double-action solid-frame revolver. Revolver 10 is further described in copending U.S. Patent Application Ser. No. 60/955,723 filed Aug. 14, 2007, which is commonly assigned to the same assignee as the present application and is hereby incorporated by reference herein in its entirety.

Revolver 10 includes a cylinder frame 12 with cylinder 16 rotatably carried by frame 12 and defining a plurality of chambers 13 formed therein for holding cartridges. Cylinder 16 is supported by a cylinder crane 88 including an upper support tube 101 received through the hub of the cylinder and a lower retaining pin 19 removably received through aperture 56 of the crane. Cylinder crane 88 is used to pivot cylinder 16 laterally outwards from cylinder frame 12 for loading cartridges into chambers 13. In other embodiments, access to the cylinders for loading cartridges may be alternatively provided via a revolver design that includes a pivoting loading gate attached to the rear of the frame behind the cylinders or a pivoting/breakable frame that allows the cylinder to be folded forward away from the rear of the frame. Accordingly, the invention is not limited to any particular type of revolver design and has broad applicability.

With continuing reference to FIG. 3, revolver 10 further includes a barrel 14 extending forward from cylinder frame 12 and defining an internal bore which preferably includes rifling 15 as shown. In one embodiment, barrel 14 may be integral with frame 12 as shown or alternatively may be a separate component that is threadably attached to frame 12 (not shown) in a conventional manner well known to those skilled in the art. In a preferred embodiment, cylinder frame 12 is preferably made of metal, and more preferably may be aluminum, titanium, or steel.

Figure 4:
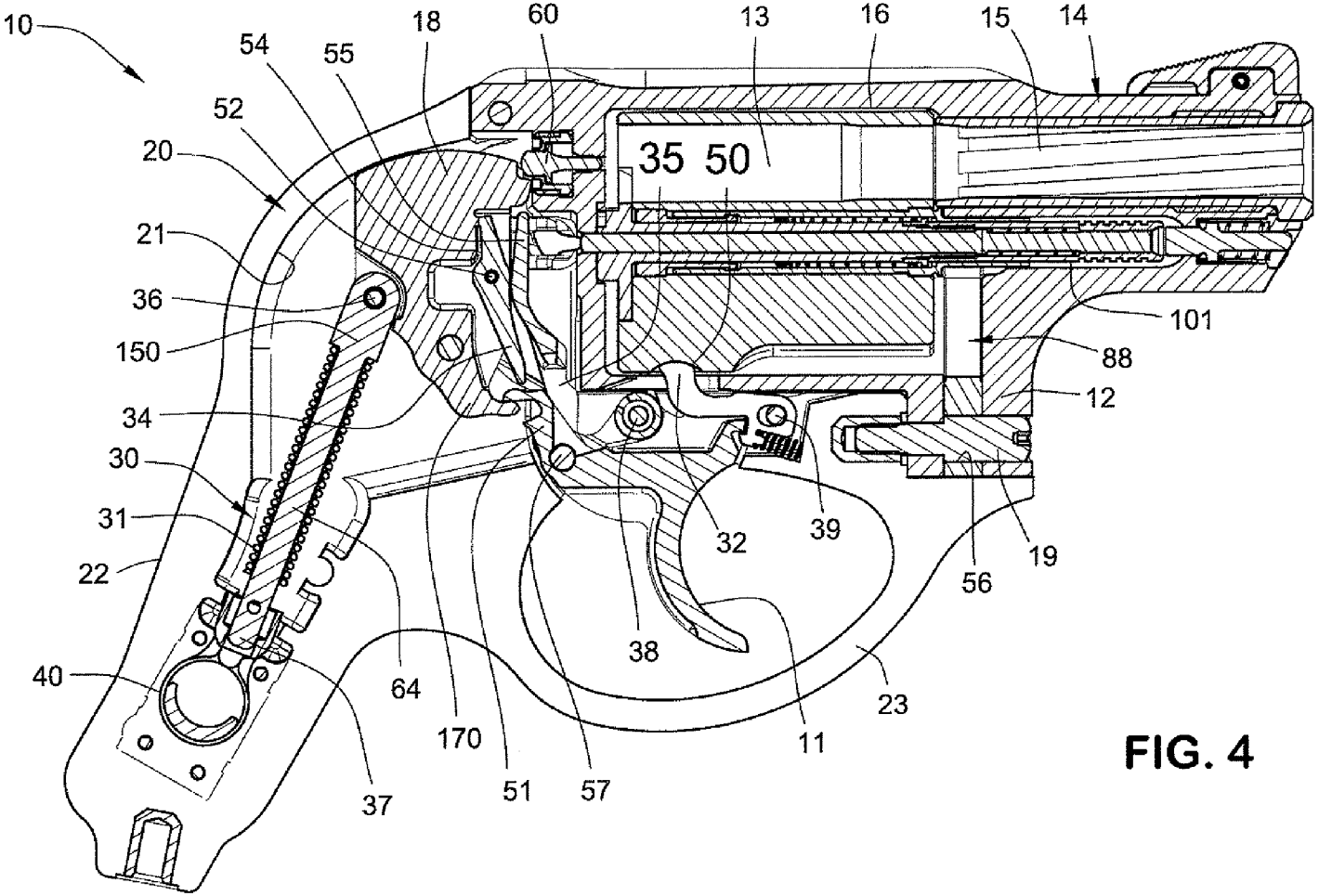
FIG. 4 is a left side cross-sectional view thereof.

With reference to FIGS. 3 and 4, revolver 10 further includes a separate firing control housing 20 attached to the rear of cylinder frame 12 for mounting and housing the firing control mechanism components used to operate and discharge the revolver. In one embodiment, firing control housing 20 is removably attachable to cylinder frame 12. In one embodiment, the rear of firing control housing 20 includes an elongated rear grip tang 22 for supporting and mounting a one-piece or two-piece hand grip (not shown) thereto. In one possible embodiment as shown, firing control housing 20 preferably may include a forward extending portion defining an integral trigger guard 23. In other embodiments, trigger guard 23 may be a separate component that attaches to firing control housing 20 and/or cylinder frame 12.

Referring now to FIGS. 3 and 4, revolver 10 in a preferred embodiment further includes a firing control mechanism which in some embodiments may be completely supported by firing control housing 20 that is independent of the cylinder frame 12, and which mechanism generally includes the following firing control components: trigger 11, hammer 18 with hammer operating protrusion such as hammer lever or dog 34, cylinder lock 32, pawl 35, and mainspring assembly 30 with mainspring 31. Mainspring assembly 30, in one embodiment, includes mainspring strut 64 having an upper end 150 engaged with pin 36 of hammer 18 and a lower end 37 braced against a portion of grip tang 22. In one embodiment shown in the figures, lower end 37 of strut 64 is engaged with a rotary lock 40 that may be provided and disposed in grip tang 22. Hammer dog 34 is essentially a spring-biased elongated lever that is pivotably mounted or coupled to hammer 18 about a pinned connection 52 and is operably positioned between trigger 11 and hammer 18 (see also FIG. 9). Hammer dog 34 is biased upwards (clockwise in FIG. 3) and away from sear 170 of hammer 18 by a spring 54 (best shown in FIG. 4) and is positioned to be engageable by the rear of trigger 11. As further described herein, hammer dog 34 is rotated upwards by trigger 11 in response to a trigger pull for cocking the hammer 18. In other possible embodiments where hammer 18 may not include a hammer dog, trigger 11 may directly engage a portion of hammer 18 for cocking the hammer.

Hammer 18 is pivotably mounted to firing control housing 20 about a pinned connection 53 and is movable in rearward and forward arcuate motions related to cocking and releasing the hammer, respectively. Hammer 18 is biased forward towards the cylinder by mainspring 31 as noted above. As shown in the preferred embodiment, hammer 18 may be spurless and movably disposed completely internal to cavity 21 of firing control housing 20. In one embodiment, the upper portion hammer 18 may have a rounded or arcuate profile and upper surface as shown that complements a corresponding inner profile of cavity 21. Since firing control housing 20 is advantageously completely enclosed in the preferred embodiment, foreign debris cannot enter cavity 21 and contaminate the firing control mechanism unlike some conventional housing designs which sometimes have an upper opening even when spurless hammers are used. Although hammer 18 described herein is configured as an internal spurless hammer, the present invention is not be limited in this regard. Accordingly, hammers with spurs and/or externally accessible hammers which may be manually cocked by a user for single action operation may be used. Accordingly, the invention is not limited to internal spurless hammer revolver designs as illustrated by the embodiments disclosed herein.

With continued reference to FIGS. 3 and 4, trigger 11 is pivotably mounted to firing control housing 20 about a pinned connection 38 and moves arcuately in response to a trigger pull by a user. Trigger 11 is biased downwards (i.e. clockwise as viewed in FIG. 3) and forward by trigger torsion spring 33. Cylinder lock 32 is mounted about pinned connection 39 to firing control housing 20 and is actuated by trigger 11. Cylinder lock 32 keeps one of the chambers 13 concentrically aligned with the bore of barrel 14 during firing. Cylinder lock 32 is preferably biased upwards by a spring (not shown) into engagement with a cylinder lock depression 50 formed in cylinder 16. Preferably, a cylinder lock depression 50 is provided for each chamber. When trigger 11 is pulled rearwards, a front portion of the trigger ahead of pinned connection 38 rotates downwards (counter-clockwise in FIG. 3) which engages and rotates cylinder lock 32 downwards in an opposite direction (clockwise in FIG. 3) about pin 39. This motion disengages cylinder lock 32 from one of the cylinder lock depressions 50 (see FIG. 3) so that cylinder 16 may be rotated by pawl 35 in a conventional manner to the next firing position in response to pulling the trigger 11. When trigger 11 reaches a predetermined rearward point and a cylinder 13 containing the next cartridge to be discharged aligns with barrel 14, cylinder lock 32 is released by the trigger and returns to its initially upward position to engage an new cylinder lock depression 50. Further rearward motion of hammer 18 releases the hammer to strike and detonate the cartridge directly or indirectly via an intermediate firing pin carried by the cylinder frame 12 positioned between the hammer and cartridge.

As described above, pulling trigger 11 also cocks and releases hammer 18 to discharge revolver 10 in a manner to be further described herein. When trigger 11 is pulled, a rear operating arm or extension 51 projecting rearwards from the trigger engages and rotates hammer dog 34 upwards (clockwise in FIG. 3), which in turn rotates hammer 18 rearwards (clockwise in FIG. 3) to a predetermined point where the hammer is then released to strike a cartridge in one of the chambers 13 via an intermediate spring-loaded firing pin 60 disposed between the hammer and cartridge.

With reference to FIGS. 3-4, the firing control mechanism of revolver 10 may include a transfer bar 55 in some embodiments. Transfer bar 55 is vertically movable in response to a trigger pull and reduces the likelihood that the revolver will fire in the absence of a trigger pull. In one embodiment, transfer bar 55 may be positioned forward of hammer dog 34 and is movably coupled to trigger 11 via a pinned connection 57. Pawl 35 may also be movably coupled to trigger 11 via same pinned connection 57 or by a different connection. The spring-loaded firing pin 60 (shown in FIGS. 3 and 4 without the spring for clarity) is received in a recess formed in cylinder frame 12 and axially movable therein to strike a cartridge when loaded in chamber 13. When trigger 11 is pulled, transfer bar 55 moves vertically upwards in response and becomes positioned between hammer 18 and firing pin 60. As hammer 18 becomes fully cocked and is then released as described herein, the hammer strikes transfer bar 55 which in turn transfers the force to firing pin 60 propelling the firing pin forward to strike a cartridge. In the absence of a trigger pull, hammer 18 preferably is incapable of reaching firing pin 60 when the hammer is in its forward-most position.

A specially configured trigger 11 according to one embodiment of the present invention will now be described that is intended to reduce trigger pull pressure requirements and provide smoother trigger action. Trigger 11 is preferably configured to operably engage a protrusion extending outwards from the hammer 18. In one preferred embodiment, trigger 11 is configured to engage hammer dog 34, which may be pivotally and operably coupled to hammer 18 as described herein.

Figure 5:
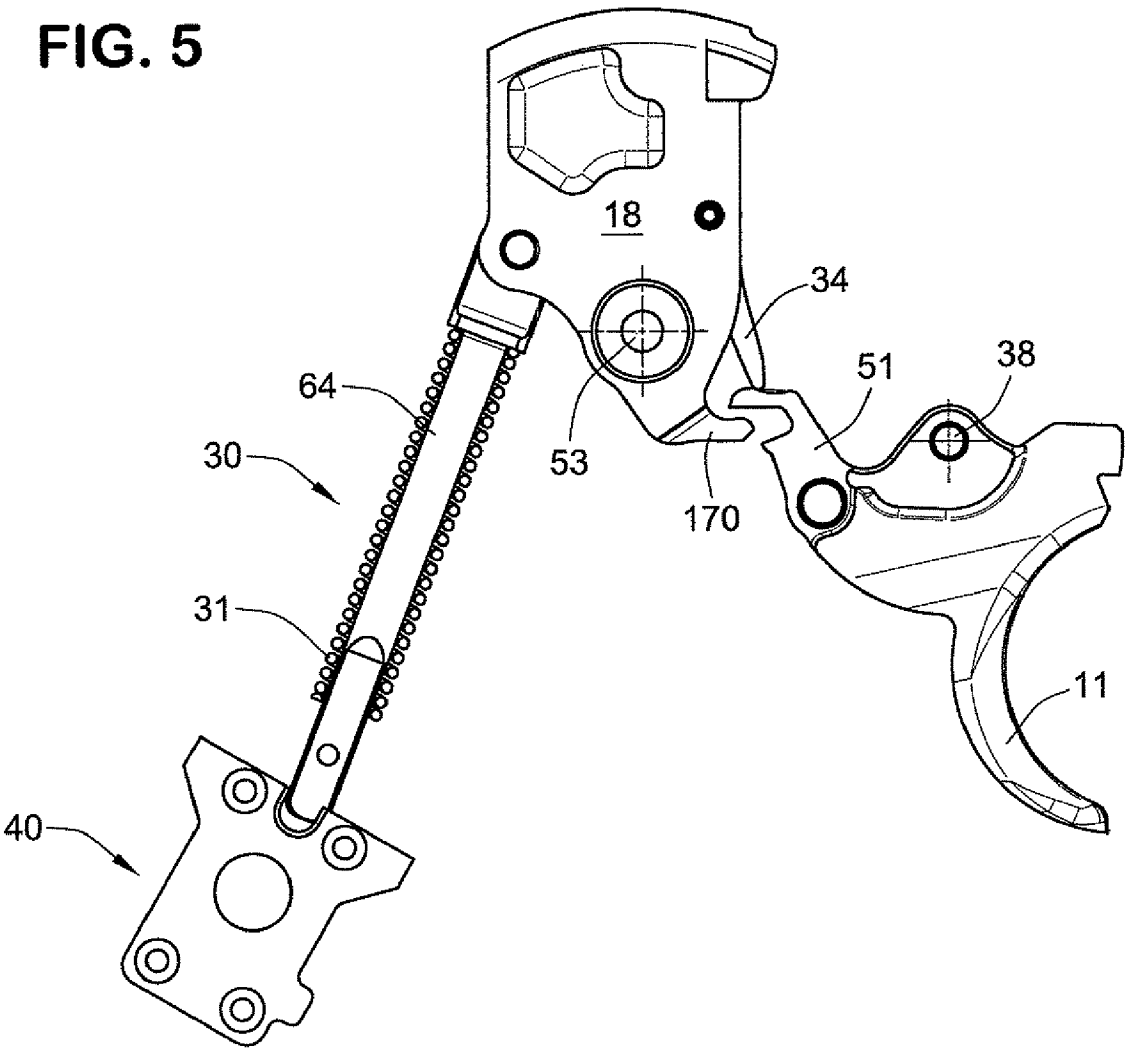
FIG. 5 is a right side view of the trigger-hammer mechanism components of the revolver of FIG. 3 being disembodied for clarity and the trigger being initially engaged with the hammer dog in response to pulling the trigger.
Figure 6:
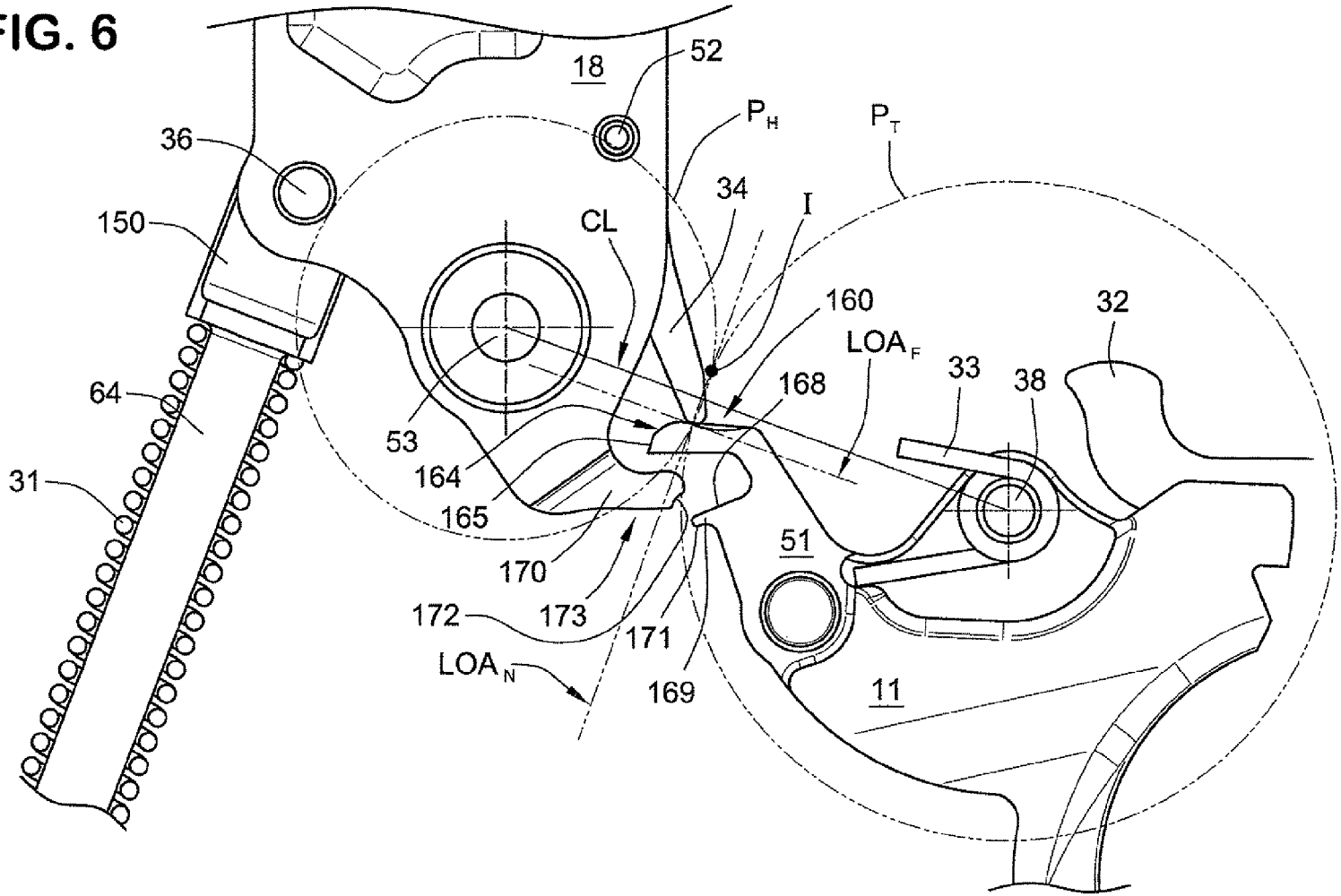
FIG. 6 is a detailed view of the trigger-hammer mechanism taken from FIG. 5.

Initial reference is made to FIGS. 5 and 6 for discussion of the technical operating principles associated with the trigger mechanism according to the present invention. FIG. 5 shows the trigger and hammer mechanism disembodied from revolver 10 for clarity with hammer dog 34 making initial contact with rear operating extension 51 in response to a trigger pull. FIG. 6 is a close up view taken from FIG. 5.

Referring now to FIGS. 5 and 6, the firing control mechanism comprising trigger 11 and hammer 18 operate under the principle of leverage. Rear operating extension 51 of trigger 11 defines a first class lever having a fulcrum at pivot pin 38. Similarly, hammer 18 with operably attached hammer dog 34 also defines a first class lever having a fulcrum at pivot pin 36. A centerline CL is defined between pivot pin 38 of trigger 11 and pivot pin 53 of hammer 18. The trigger 11 multiplies the mechanical force (i.e. finger pull pressure) applied by the user to the finger portion 162 of the trigger and delivers that magnified applied force $F_T$ to hammer 18 through hammer dog 34. Hammer 18 in turn will create an opposite resistance force $F_H$ back onto rear operating extension 51 of trigger 11 created by the biasing force of mainspring assembly 30 which acts on the hammer as shown in the figures.

Figure 7:
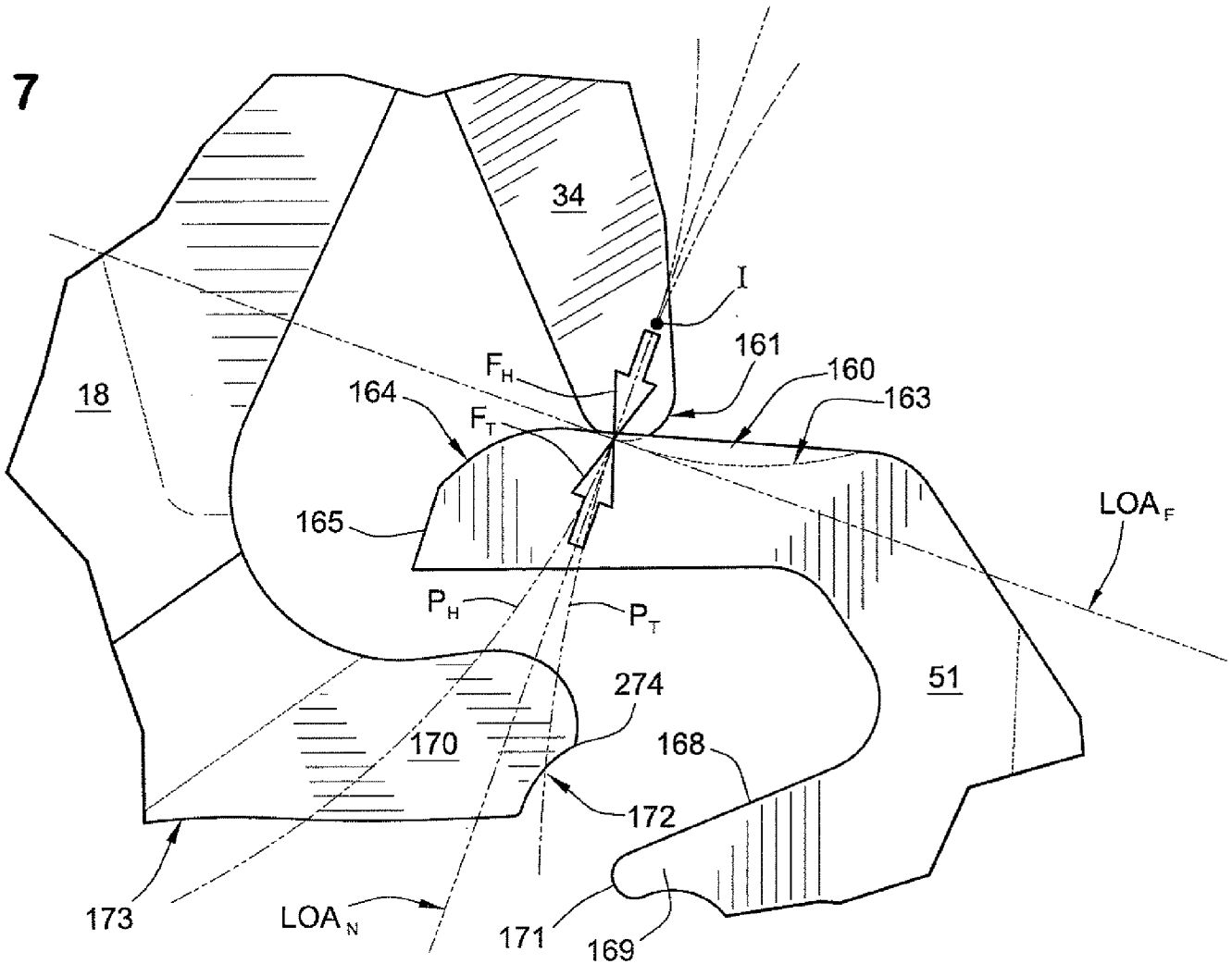
FIG. 7 is a force vector diagram based on FIG. 6 showing normal forces acting between the trigger and hammer contact surfaces with the trigger being initially engaged with the hammer dog in response to pulling the trigger.

With reference to FIGS. 5-7, rear operating extension 51 of trigger 11 defines an arcuate rotational path or arc of motion $P_T$ about trigger pivot pin 38. Correspondingly, hammer 18 defines an arcuate rotational path or arc of motion $P_H$ about hammer pivot pin 53. Rotational paths $P_T$ and $P_H$ intersect at point I in a tangential relationship to each other, which in one embodiment may be proximate to the point where contact surface 160 on rear operating extension 51 of trigger 11 contacts corresponding contact surface 161 on hammer dog 34 (see also FIG. 7). The intersection of rotational paths $P_T$ and $P_H$ define a theoretical ideal mutual line of action $LOA_N$ of the applied normal forces $F_T$, $F_H$ acting between and normal to contact surfaces 160 and 161 that is tangent or very nearly tangent to paths $P_T$, $P_H$ as practicable wherein the mechanical advantage is greatest. Provided that the applied normal forces $F_T$ and $F_H$ act generally along line $LOA_N$, the frictional component of sliding contact forces due to sliding between contact surfaces 160 and 161, which act along line of action $LOA_F$ in a direction generally perpendicular to line $LOA_N$ and parallel to each contact surface as shown, will be kept to a minimum making the trigger easier for the user to pull. If the applied force $F_T$ acts obliquely to line of action $LOA_N$, however, the frictional component of the contact forces between surfaces 160 and 161 increases which must be overcome by exerting higher applied finger pressure on the trigger 11 in order to cock the hammer 18 rearwards about pin 53. Accordingly, line of action $LOA_N$ represents the hammer's path of least resistance to pivotal movement about pin 53. It is also important to note that the theoretical mechanical advantage (ignoring frictional effects) of the trigger/hammer/hammer dog system is at a minimum at the start of the trigger pull cycle. Therefore, limiting the resisting moment caused by the friction force (found by multiplying the perpendicular distance of the line of action of the frictional force from the trigger pivot by the frictional force itself) at the start of the trigger pull is one important key to ensuring that the actual mechanical advantage is as close as possible to the theoretical.

Figure 2:
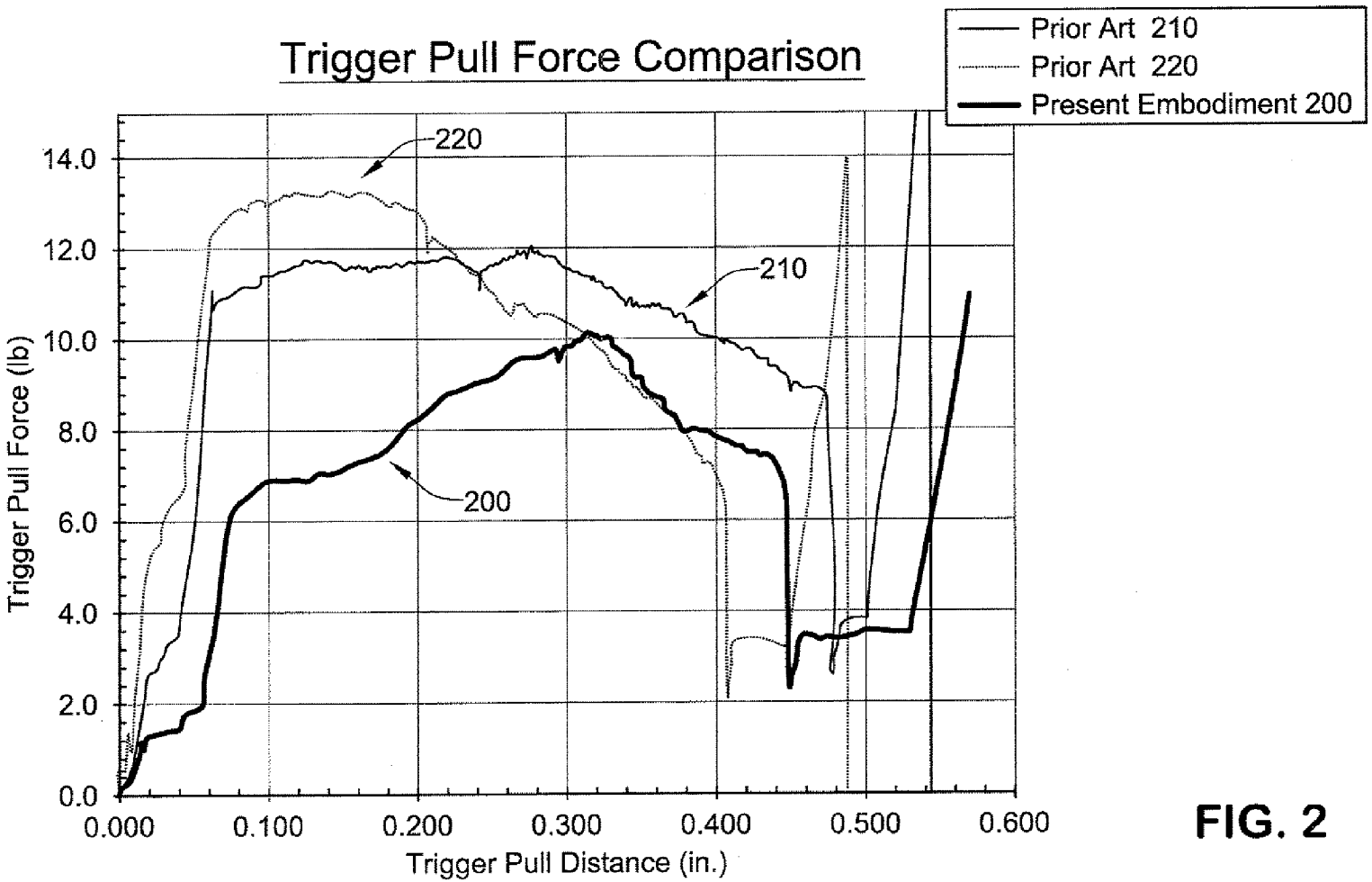
FIG. 2 is a graph showing the results of a trigger pull force comparison test of a trigger according to the present invention compared with two conventional known revolver trigger designs.

The present invention provides a trigger 11 that is configured and arranged so that contact surface 160 of trigger 11 engages contact surface 161 of hammer dog 34 in manner that applied normal forces $F_T$ and $F_H$ between these contact surfaces act in a direction along line of action $LOA_N$ that is tangent or very nearly tangent to paths $P_T$ and $P_H$. Preferably, contact surfaces 160 and 161 engage so that applied normal forces $F_T$ and $F_H$ act substantially along line of action $LOA_N$ for the portion of engagement between the hammer dog 34 and trigger 11 where the mechanical advantage of the system remains essentially unchanged near its minimum value (i.e. from initial contact shown in FIG. 12 until the transition point shown in FIG. 14 where trigger 11 now also directly engages a portion of hammer 18 along with hammer dog 34). Referring to FIGS. 5-9, this is provided in one embodiment by mutually configuring contact surfaces 160 and 161 of trigger rear operating extension 51 and hammer dog 34, respectively, such that the two contact surfaces remain mutually engaged and oriented perpendicular or close to perpendicular to line of action $LOA_N$ during the trigger pull to the greatest extent practicable. Therefore, the applied forces $F_T$ and $F_H$ resulting between contact surfaces 160 and 161 will be normal (i.e. perpendicular) to these contact surfaces and act along line $LOA_N$; the path of least resistance for cocking hammer 18. As shown in FIG. 2, this advantageously decreases the trigger pull force or pressure required to cock hammer 18 in contrast to conventional trigger designs. In addition, the peak or maximum trigger pull force required is less than conventional trigger designs when the same mainspring 31 having the same spring force (k) is used. Overall, trigger 11 results in smoother trigger operation and reduces the abrupt decrease in finger pull pressure found in conventional trigger designs which may cause the revolver 10 to jerk or jump suddenly, as discussed above.

Figure 9:
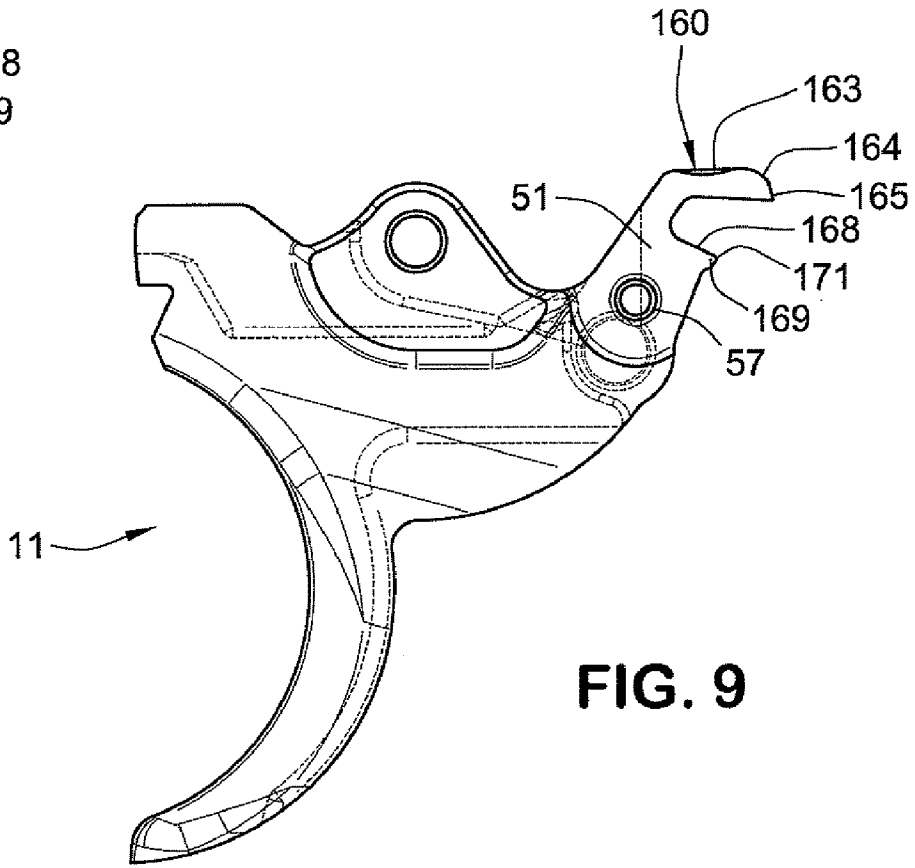
FIG. 9 is a left side view of the trigger of FIG. 8.
Figure 8:
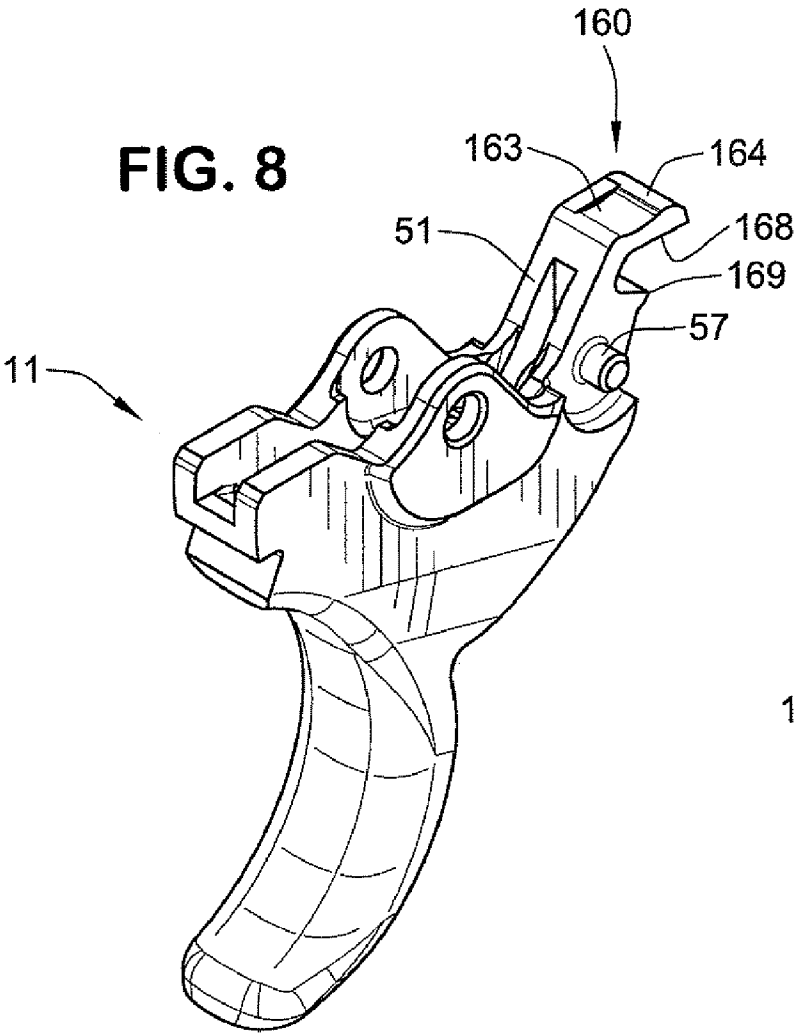
FIG. 8 is a perspective view of the trigger of FIG. 3.

Trigger 11 according to one embodiment of the present invention is shown in FIGS. 8 and 9. Trigger 11 includes a conventional finger portion 162 for pulling the trigger and an elongated rear operating extension 51 which extends rearwards from the trigger. Rear operating extension 51 includes a contact surface 160 formed in the top of extension 51 which is configured and arranged for engaging corresponding contact surface 161 of hammer dog 34 in the manner described elsewhere herein. In one embodiment, contact surface 160 includes a rounded concave camming surface 163. Concave camming surface 163 is preferably configured and arranged such that when trigger 11 is first pulled and shortly thereafter, contact surface 161 of hammer dog 34 initially engages camming surface 163 in the manner further described elsewhere herein so that contact normal forces $F_T$ and $F_H$ act substantially along line of action $LOA_N$ to the greatest extend practicable (see also FIG. 7 showing force vectors for forces $F_T$ and $F_H$). In one embodiment, hammer dog 34 initially contacts a forward sloping portion of camming surface 163 as shown. Contact surface 160 of trigger rear operating extension 51 may further include a contiguous convex camming surface 164 disposed adjacent to and extending rearward from camming surface 163. Camming surface 164 is preferably configured and arranged such that during the remainder of the trigger pull, contact surface 161 of hammer dog 34 remains engaged with camming surface 164 in the manner further described elsewhere herein so that contact normal forces $F_T$ and $F_H$ continue to act substantially along line of action $LOA_N$ (see FIGS. 6 and 7) for the period of time where the mechanical advantage of the system remains essentially unchanged near its minimum value (i.e. from initial contact shown in FIG. 12 until the transition point shown in FIG. 14 where trigger 11 now also directly engages a portion of hammer 18 along with hammer dog 34). As surface 161 of hammer dog 34 continues its motion along convex surface 164 of trigger 11 during the trigger pull the rotation of trigger 11 and hammer dog 34 (and by extension hammer 18) are such that the normal force vectors $F_T$ and $F_H$ are unable to continue to act in a substantially parallel direction to the mutual line of action $LOA_N$ shared between the components. Frictional force vectors (perpendicular to $F_T$ & $F_H$) acting along frictional line of action $LOA_F$ and the resisting moments created by them begin to have a larger effect on the trigger pull force required by the user to continue actuating the trigger mechanism. However, this coincides with the mechanical advantage of the system beginning to increase from the transition position of hammer 18 and trigger 11 shown in FIG. 14, which in part offsets the increasing frictional component of the trigger pull force required. Concave and convex camming surfaces 163, 164 together combine to define an undulating sinuous-shaped contact surface 160 in one embodiment. In other possible embodiments, camming surface 164 may be generally flat or planar (not shown) extending rearwards from concave camming surface 163 to rear end 165. Trigger 11 is pivotally movable from a deactivated fully forward position (see, e.g. FIG. 3) to an activated rear position associated with fully cocking and releasing hammer 18 to discharge revolver 10.

With continuing reference to FIGS. 8 and 9, and also to FIG. 6, rear operating extension 51 of trigger 11 may further define a rearwardly open recess 168 configured for receiving a forwardly-projecting trigger engaging leg or sear 170. Rear operating extension 51 further defines a hammer engaging ledge 169 configured to engage sear 170 for pivoting hammer 18 rearwards as further described herein. In one embodiment, trigger 11 may include a rear sear engaging edge 171 that engages a complementary configured concave sear notch 172 on sear 170 of hammer 18. Sear engaging edge 171, which may be provided on rear operating extension 51 in one embodiment and may be radiused/rounded for smooth operation, is positioned for holding hammer 18 in a fully cocked position if revolver 10 is operated in a single action mode and provided with an externally accessible spurred hammer (i.e. hammer 18 having been cocked manually wherein a trigger pull simply releases the cocked hammer to discharge the revolver). A sear edge 272 is provided adjacent sear notch 172, which defines a "sear off" point wherein pulling trigger 11 further ultimately releases hammer 18 for discharging revolver 10.

Figure 10:
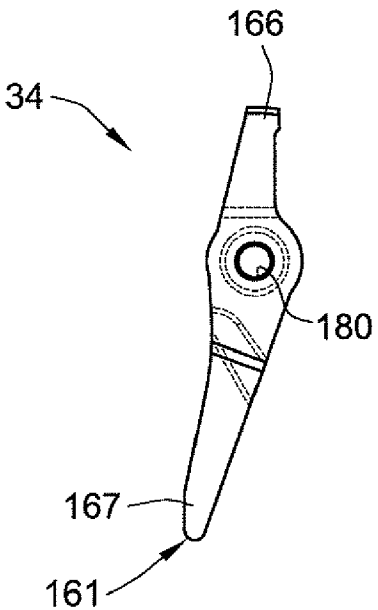
FIG. 10 is a side view of one embodiment of the hammer dog of FIG. 3.

Hammer dog 34 is shown in further detail in FIG. 10. Hammer dog includes one end 166 configured and arranged to engage a portion of hammer 18 for actuating the hammer and an opposite end 167 that defines contact surface 161 for engaging corresponding contact surface 160 on trigger 11. In one embodiment, contact surface 161 may preferably be radiused and arcuately shaped or rounded to smoothly engage rear operating extension 51 of trigger 11. The arcuate shape of contact surface 161 assists in providing smooth trigger operation as surface 161 remains in contact with and progresses from engagement with concave camming surface 163 to convex camming surface 164 over the full range of the trigger pull. Hammer dog 34 further defines an aperture 180 for receiving a pin for forming pinned connection 52 between the hammer dog and hammer 18 (see, e.g. FIG. 3).

Figure 11:
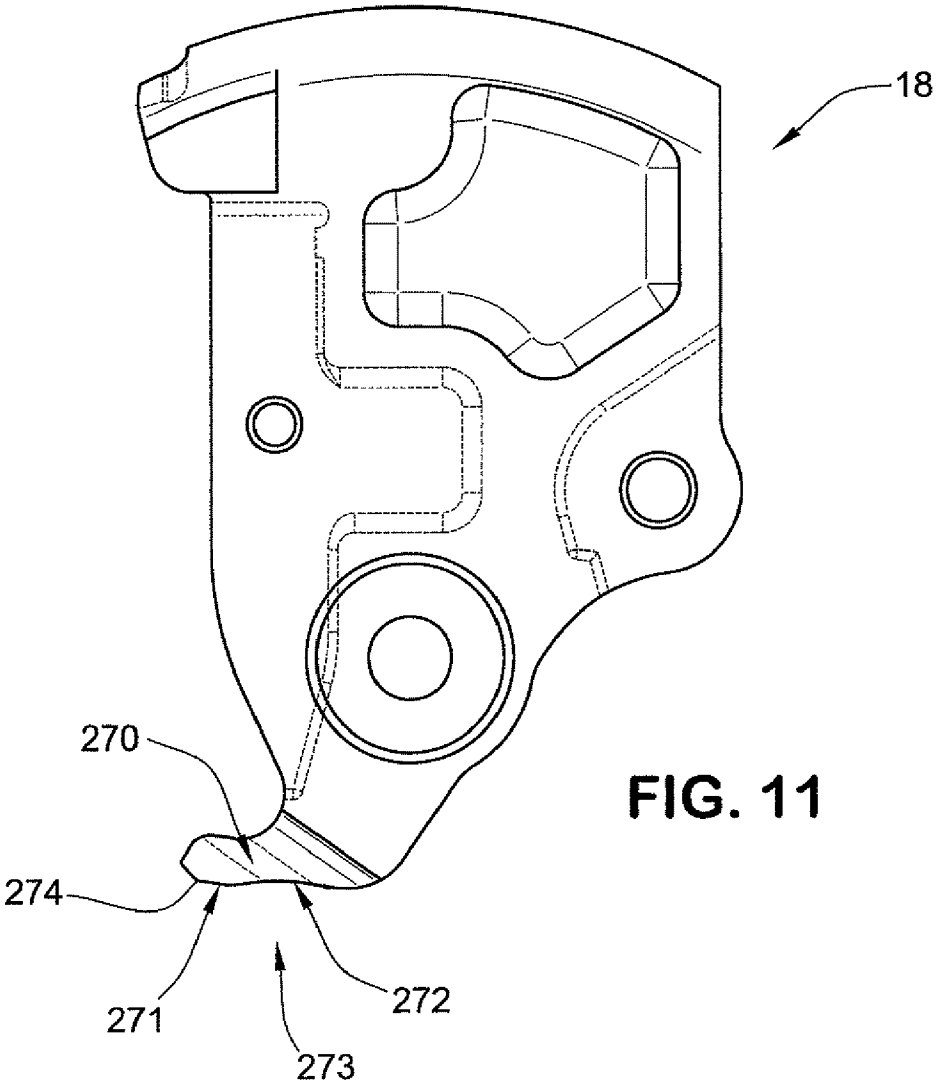
FIG. 11 is side view of one alternative embodiment of a hammer having a non-planar contoured sear usable with the revolver of FIG. 3.

According to another aspect of the invention. FIG. 11 shows an alternate and preferred embodiment of a hammer 18 with a contoured hammer sear 270 usable with a revolver trigger mechanism according to the present invention. Whereas sear 170 (shown in FIGS. 5 and 6, for example) has a generally flat or planar lower operating surface 173 that engages trigger 11, sear 270 shown in FIG. 11 is configured differently having a radiused, none planar contoured lower operating surface 273. The inventor has discovered that contouring lower operating surface 273 further reduces the trigger pull or input force required by a user from approximately the point when rear operating extension 51 of trigger 11 engages sear 270 of hammer 18 (at the transition position of trigger-hammer mechanism shown in FIG. 14) until the trigger releases the hammer to discharge revolver 10. Advantageously, contoured lower operating surface 273 provides smoother trigger operation and lower trigger input force over the remainder of the trigger pull after the hammer dog 34 disengages from trigger 11.

Referring now to FIG. 11, alternative hammer sear 270 in one embodiment includes a contoured lower operating surface 273 defining a convex camming surface 271, an adjoining concave camming surface 272, and a sear edge 274 defining a sear-off point on hammer 18 wherein trigger 11 is operable to release the hammer and discharge revolver 10. Preferably, convex camming surface 271 is located forward of concave camming surface 272 as shown. In contrast to sear 170, which has a pronounced concave sear notch 172, sear 270 instead replaces the sear notch with convex camming surface 271 between sear edge 274 and concave camming surface 272. In a preferred embodiment, convex camming surface 271 may be only slightly convex in shape.

Operation of trigger 11 to cock and release hammer 18 for discharging revolver 10 will now be described with reference to FIGS. 11 and 12-16 with respect to the double action operating mode of revolver 10. In this embodiment, hammer 18 preferably includes contoured sear 270 shown in FIG. 11; however, it will be appreciated that in other embodiments a sear similar to sear 170 shown in FIG. 6 or other designs may be used. FIGS. 12-16 show the operating sequence of a trigger pull and the relative positions of rear operating extension 51 of trigger 11 and hammer 18 with operably attached hammer dog 34.

FIG. 3 shows revolver 10 with the firing control mechanism in a standby condition with trigger 11 being in the forward deactivated position and hammer 18 being in the fully forward uncocked position before the trigger is pulled by the user. Rear operating extension 51 may be positioned slightly below and apart from hammer dog 34 as shown, or lightly abutting the hammer dog. Hammer 18 is biased fully forward in an uncocked position by mainspring 31. Sear 270 of hammer 18 is at least partially received in recess 168 of trigger 11. In one embodiment, rear operating extension 51 may be supported by sear 270 as shown against the forward and clockwise biasing force (as viewed in FIG. 3) of trigger spring 33.

Figure 12:
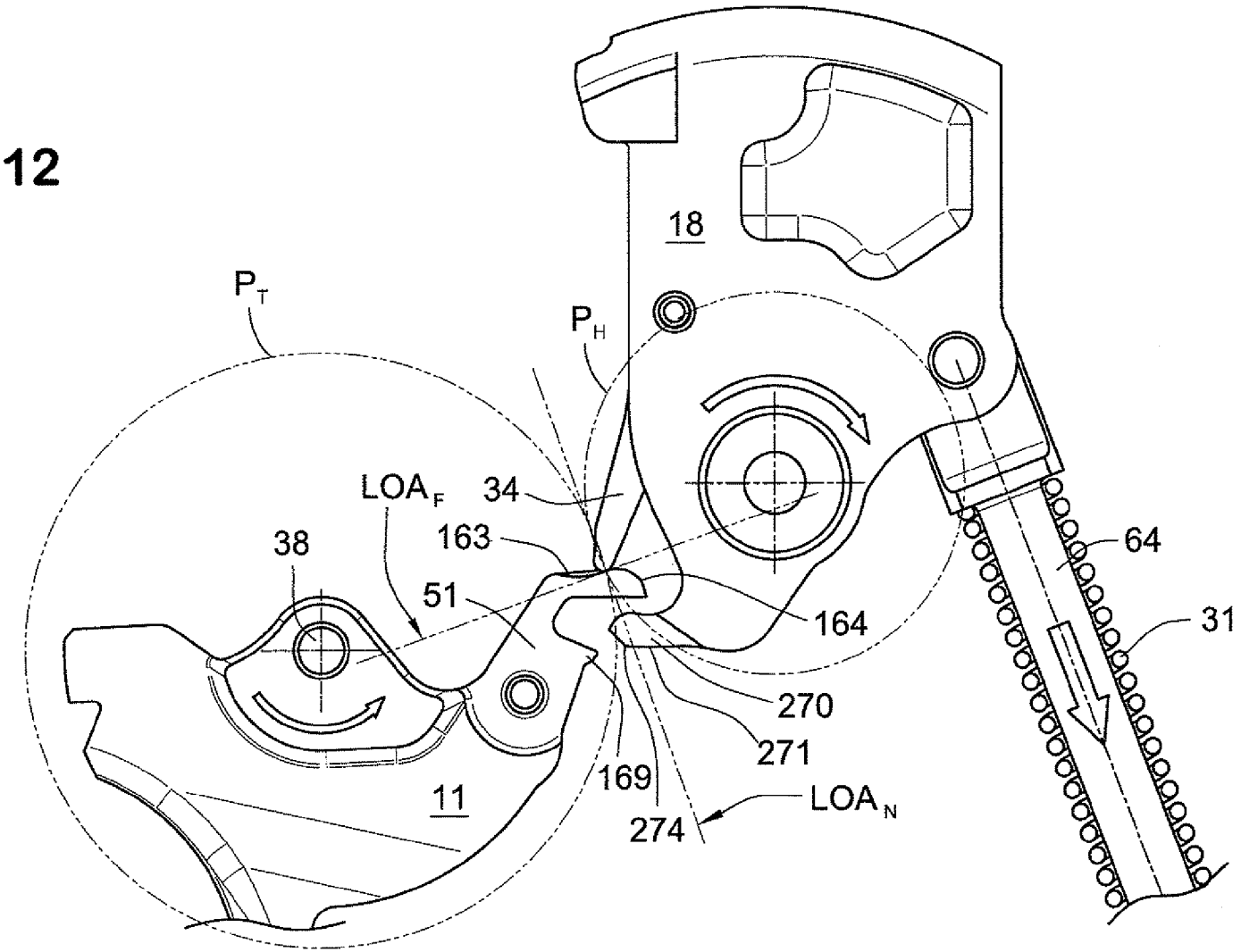
FIGS. 12-16 are operational views of the firing control mechanism according to the present invention during sequential stages of the trigger being pulled showing the trigger, hammer, and hammer dog in various positions.

Referring now to FIG. 12, trigger 11 and hammer 18 are shown when the trigger makes initial contact with the hammer in response to a trigger pull. When the user begins to pull rearward on trigger 11 in the double action mode of operation, contact surface 160 of trigger rear operating extension 51 rotates counterclockwise (as viewed in FIG. 10) and initially engages contact surface 161 of hammer dog 34 for the first part of the trigger pull. This causes hammer 18 to begin rotation clockwise about pin 53 (via hammer dog 34) and partially cocks the hammer while compressing mainspring 31. Contact surface 161 of hammer dog 34 engages a portion of concave camming surface 163, which may be a forward sloping portion of the camming surface as shown. Preferably, camming surface 163 is arranged to mate with contact surface 161 such that the normal applied forces $F_T$ and $F_H$ on surfaces 161 and 163 are acting substantially along ideal line of action $LOA_N$ (see, e.g. FIGS. 6-7) as described elsewhere herein resulting in reduced trigger pull or input force requirements.

Figure 13:
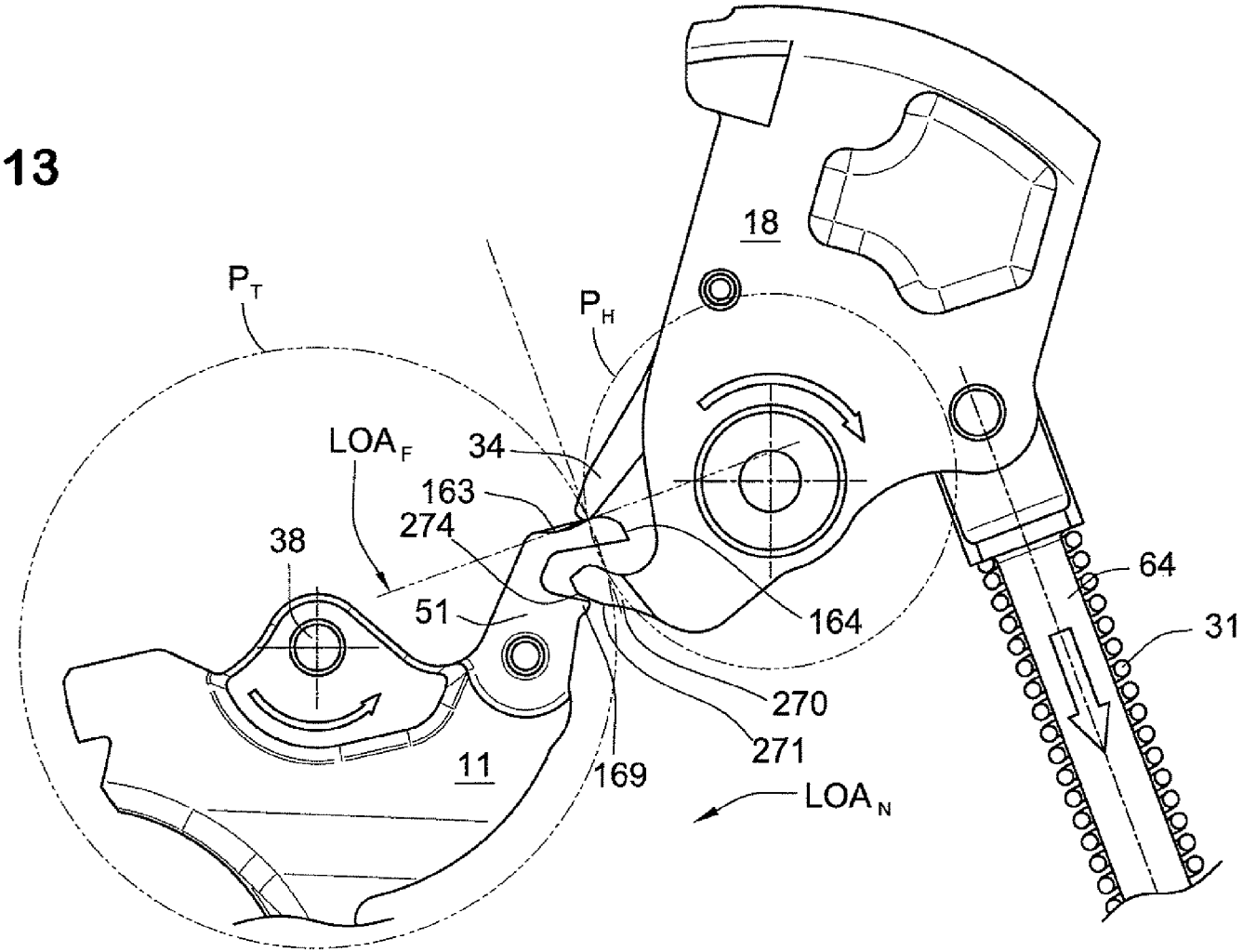

Referring now to FIG. 13, trigger 11 and hammer 18 are shown in a first intermediate cocked position during the trigger pull with the trigger and hammer being partially actuated. As the user continues to pull rearward on trigger 11 from the position shown in FIG. 12, contact surface 160 of trigger 11 remains in contact and engaged with contact surface 161 of hammer dog 34. Hammer dog 34 progressively slides rearward in position along contact surface 160 of trigger 11 as hammer 18 becomes further cocked rearward and continues rotation clockwise about pin 53 (as viewed in FIG. 13). More particularly, in one embodiment, hammer dog 34 slides on and transitions from concave camming surface 163 to convex camming surface 164 as shown in FIG. 13. This further compresses mainspring 31. Preferably, camming surfaces 163 and then 164 remain engaged with contact surface 161 of hammer dog 34 in a manner such that the normal applied forces $F_T$ and $F_H$ on surfaces 161 and 163 continue to act substantially along ideal line of action $LOA_N$ (see e.g. FIGS. 6 and 7). In FIG. 13, it should be noted that hammer engaging ledge 169 on trigger 11 (and particularly sear engaging edge 171) is in actuality slightly spaced apart from and has not yet physically contacted lower operating surface 273 on sear 270 of hammer 18.

Figure 14:
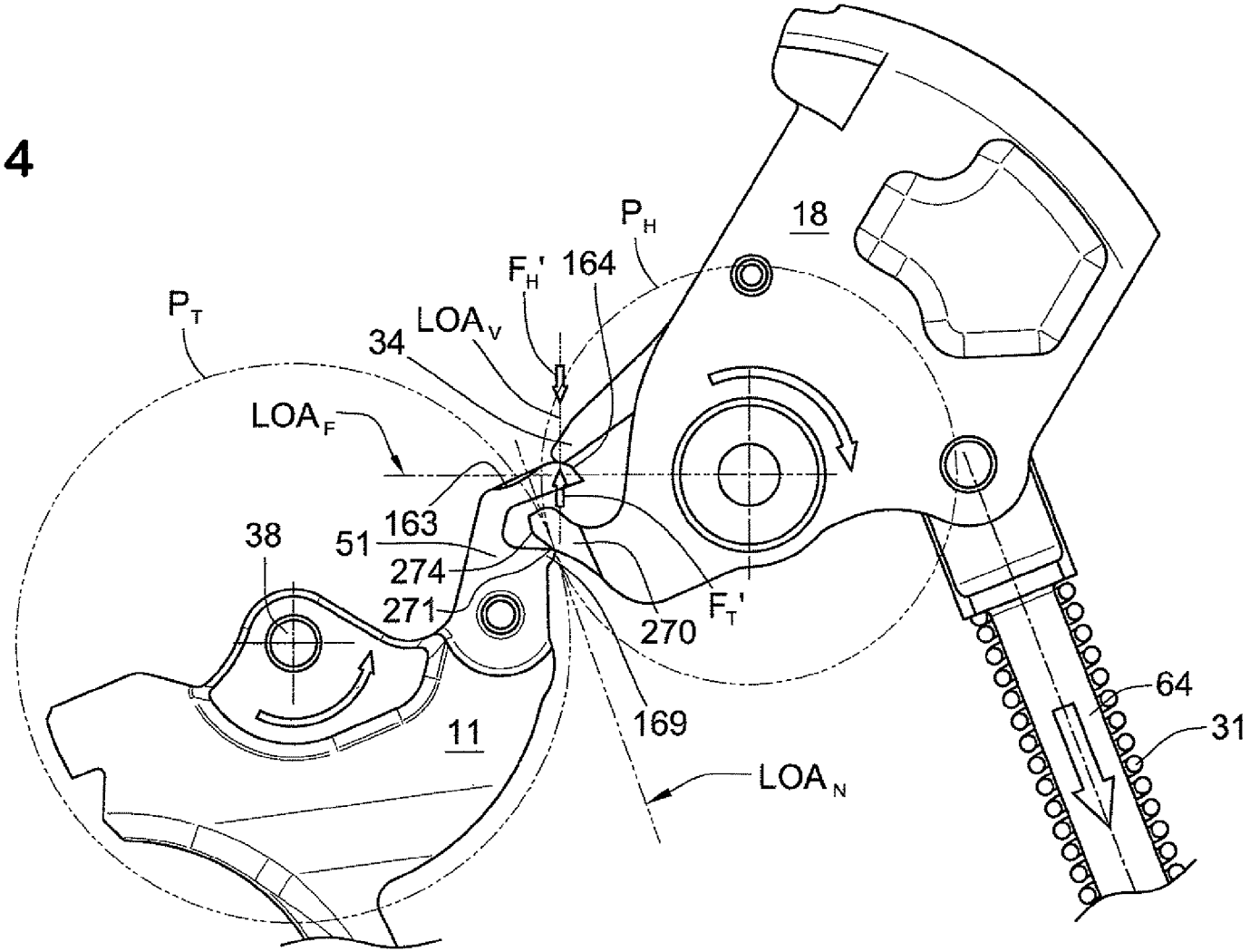

As the user continues to pull rearward on trigger 11 from the position shown in FIG. 13 towards the transition position shown in FIG. 14, contact surface 160 of trigger 11 remains in contact and engaged with contact surface 161 of hammer dog 34. Hammer dog 34 progressively moves further rearward in position along contact surface 160 of trigger 11 as hammer 18 becomes further cocked rearward and continues rotation clockwise about pin 53. Contact surface 161 of hammer dog 34 is engaged with and slides along a portion of convex camming surface 164 preferably such that the normal applied forces $F_T$ and $F_H$ on surfaces 161 and 164 act substantially on the ideal line of action $LOA_N$ at the start of the movement across surface 164 (see, e.g. FIGS. 6 and 7).

Referring now to FIG. 14, the trigger 11 and hammer 18 mechanism is shown in a transition position or point where rear operating extension 51 of the trigger now also directly engages sear 270 of the hammer along with hammer dog 34. Hammer engaging ledge 169 on trigger 11, and particularly sear engaging edge 171 in some embodiments, now contacts lower operating surface 273 on sear 270 of hammer 18 such that direct physical engagement between the trigger and hammer occurs. Accordingly, trigger 11 now engages and acts on both hammer dog 34 and sear 270 in the transition position. Both contact surface 160 and hammer engaging ledge 169 of trigger 11 act to further cock and rotate hammer 18 rearwards at least initially at the transition position of FIG. 14 and shortly thereafter until the hammer dog 34 breaks contact with the trigger. This compresses mainspring 31 even further than in FIGS. 12 and 13 in preparation for hammer release and discharge of revolver 10. By the time trigger 11 is ready to transition from pushing on the hammer dog 34 alone to pushing on sear 270 of hammer 18 as shown in FIG. 14, however, the normal applied forces $F_T$ and $F_H$ are no longer acting parallel to the ideal line of action $LOA_N$ (i.e. tangent to both paths $P_T$ and $P_H$) as discussed previously. The normal forces between hammer 18 and trigger 11, represented by $F_T'$ (prime) and $F_H'$ (prime) in FIG. 14, are now acting oblique to and offset from the ideal mutual line of action $LOA_N$, and the remaining motion between hammer and trigger are primarily sliding in nature. The main component of the remaining trigger pull force required is therefore frictional acting along frictional line of action $LOA_F$. However, as discussed elsewhere herein, the mechanical advantage of the trigger 11 begins to increase from the transition position shown in FIG. 14 to compensate for the fact that normal forces $F_T'$ and $F_H'$ do not act along ideal line of action $LOA_N$.

Referring still to FIG. 14, the optimal transition position for the trigger-hammer mechanism occurs when normal forces $F_T'$ and $F_H'$ between rear operating extension 51 and hammer dog 34 respectively act along a line of action LOAv that is substantially vertical. Accordingly, in one embodiment, convex camming surface 271 of lower operating surface 273 on sear 270 is preferably configured and arranged such that engaging ledge 169 of trigger 11 will engage camming surface 271 when line of action LOAv is substantially vertical up to an angle of about 20 degrees past vertical in a clockwise direction as shown in FIG. 14. It has been found that exceeding this angle may adversely affect resetting the trigger mechanism properly if the trigger is only partially pulled to the rear and the user desires to return the trigger to its rest position without discharging the revolver.

As described elsewhere herein, the lower operating surface 273 on sear 270 of hammer 18 in this embodiment is also contoured in a manner to ensure that the contact surface of hammer engaging ledge 169 of trigger 11 continues to move in the same direction as the sear 270. There are non-desirable geometries to the lower operating surface 273 of sear 270 such that the relative motion between hammer engaging ledge 169 of trigger 11 and lower operating surface 273 of hammer 18 may actually allow the hammer engaging ledge 169 to slide in an opposite direction relative to the sear 270 and the reverse itself for at least part of the trigger motion. This will cause an undesirable spike in trigger pull force and dwell time or delay, that will he sensible to the user.

Figure 15:
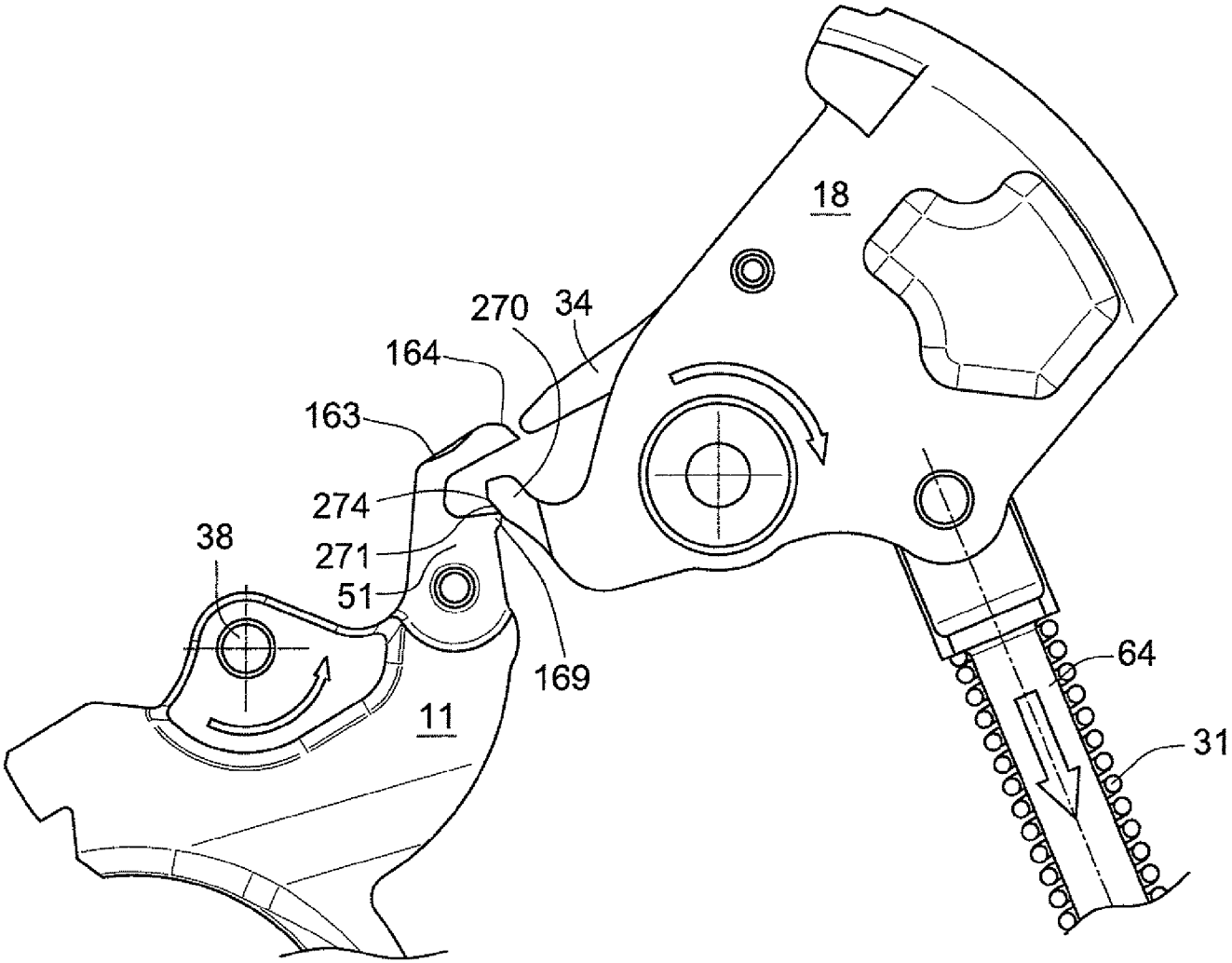
Figure 16:
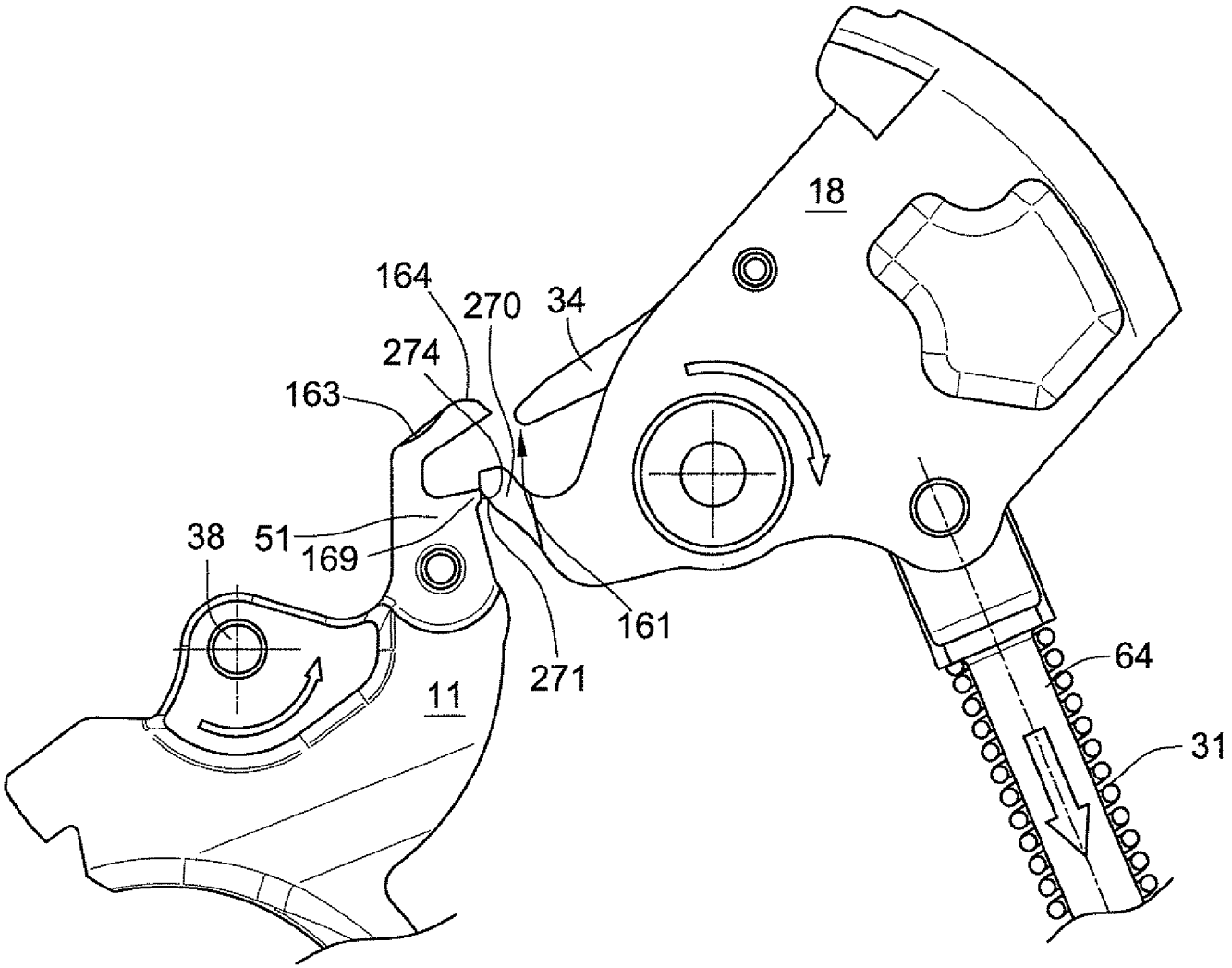

Continuing to pull trigger 11 rearward further cocks hammer 18 rearward farther back than the transition position shown in FIG. 14 towards a fully cocked release position shown in FIG. 16. Hammer engaging ledge 169 of trigger 11 engages and slides along convex camming surface 271 of sear 270 of hammer 18 towards sear edge 274 as shown in FIG. 15. As the mechanical advantage of the trigger is increasing throughout this portion of the trigger pull motion, the trigger pull force required will begin decreasing. By adding an additional curve or contour on the bottom of the sear 270 of hammer 18 such as convex camming surface 271 proximate to and preferably disposed immediately before sear edge 274 as best shown in FIG. 11 (i.e. the "sear off" point or position), a change in the mechanical advantage can be made such that the mechanical advantage of the trigger system can actually be lowered so that there is a leveling out of the trigger pull force prior to sear off. This results in a sensible change in trigger pull force required by the user which will indicate to the user that they are near the sear-off point. This, coupled with the lower overall trigger pull force requirements, can aid the user in maintaining effective aiming of the revolver.

FIG. 16 shows the trigger 11 and hammer 18 at the "sear off" point or position wherein the hammer is subsequently released forward by the trigger to discharge revolver 10. Hammer engaging ledge 169 slides along convex camming surface 271 of sear 270 as shown in FIG. 15 until it reaches sear edge 274 on the sear (see also FIG. 11). At this point, further pulling trigger 11 will break contact between hammer engaging ledge 169 and sear edge 274, which releases hammer 18 to rotate rapidly forward towards the uncocked forward position shown in FIGS. 3 and 4. Hammer 18 strikes and drives firing pin 60 forward under the biasing effect of mainspring 31 to in turn strike and detonate a chambered cartridge. As the user releases trigger 11, the trigger and rear operating extension 51 rotates forward (clockwise as shown in FIG. 3 and FIGS. 12-16). Rear operating extension 51 temporarily collapses hammer dog 34 into hammer 18 against the opposing biasing effect of hammer dog spring 54 (shown in FIG. 4) until operating extension 51 passes contact surface 161 on end 167 of the hammer dog (shown in FIG. 10). Hammer dog 34 then springs forward again and is reset to the position shown in FIG. 3. Revolver 10 is now readied for the next double action trigger pull for discharging the revolver.

FIG. 2 is a graph showing the results of a trigger input or pull force comparison test between one embodiment of a revolver trigger mechanism according to the present invention and two known prior art trigger mechanisms. Data for the present trigger mechanism is shown in the solid bold line in Curve 200. Data for the first prior art trigger mechanism is shown in Curve 210. Essentially the same mainspring having a spring constant (k) of 11 pounds/inch with an initial spring pre-load of about 6 pounds was used for both the present trigger mechanism in Curve 200 and the first prior art trigger mechanism in Curve 210. The difference in performance shown in FIG. 2 between these two trigger mechanisms correlates to the contoured trigger and hammer according to the present invention versus the prior art trigger-hammer mechanism. Data for the second prior art trigger mechanism is shown in Curve 220. The second prior art trigger mechanism is embodied in a larger revolver with bigger frame and the spring used therein accordingly had a higher spring constant (k) than the embodiment according to the present invention. Therefore, although the trigger pull force may not be directly comparable to the present invention. Curve 220 nonetheless shows the typical trigger pull characteristics of a conventional known revolver.

Referring to FIG. 2, the required trigger pull distance or stroke length (inches) is plotted along the X-axis while the corresponding trigger input or pull force (pounds) is plotted along the Y-axis. The trigger mechanisms shown have a total trigger pull distance to the "sear off" point ranging between approximately 0.4 inches and 0.48 inches (shown by sharp dip/inverted peak in this range of the curves).

Referring to FIG. 2, the portion of Curve 200 according to the present invention between 0.0 and approximately 0.1 inches of trigger pull represents the initial trigger pull and take up of the trigger mechanism until all slack is removed from the mechanism. This portion of Curve 200 is characterized by a sharp, nearly vertical increase in trigger pull force as shown between about 0.6 inches and about 0.1 inches of trigger pull distance, which roughly corresponds to the trigger mechanism position shown in FIG. 12 and shortly thereafter. The portion of Curve 200 from about 0.1 inches to about 0.32 inches of trigger pull distance represents the portion of the trigger pull after initial engagement of trigger 11 with hammer 18 (FIG. 12) and thereafter until the transition position of the trigger-hammer mechanism shown in FIG. 14 is reached at about 0.32 inches. Contact surface 160 of rear operating extension 51 on trigger 11 is engaging only corresponding contact surface 161 of hammer dog 34 during this portion of the trigger pull, as shown in FIG. 13 which shows one position during this time of the trigger and hammer dog. Between 0.0 and about 0.32 inches of trigger pull, it should be noted that applied normal forces $F_T$, $F_H$ acting between and normal to contact surfaces 160 and 161 of trigger 11 and hammer dog 34, respectively acts substantially along ideal mutual line of action $LOA_N$ for preferably the majority of time.

With continuing reference to FIG. 2 and Curve 200 according to one embodiment of the present invention, the trigger-hammer mechanism transition position or point is reached at about 0.32 inches of trigger pull distance. As shown in FIG. 14 and described elsewhere herein, both hammer dog 34 and sear 270 of hammer 18 engage rear operating extension 51 of trigger 11. The pushing force of the trigger begins to transition or transfer from the hammer dog 34 to lower operating surface 273 of sear 270. The peak or maximum trigger pull force required to be input by a user to the trigger mechanism of about 10.1 pounds as shown coincides substantially to the transition position of the trigger 11 and hammer 18 mechanism. By contrast, the maximum trigger pull force required for prior art trigger mechanisms in Curves 210 and 220 is higher at approximately 13 and 12 pounds, respectively. Advantageously, the trigger mechanism according to the present invention has a lighter trigger pull than the heavier-feel conventional double action trigger pulls of the prior art. In particular, it is noteworthy that when the trigger mechanism of the present invention (Curve 200) is compared to the first prior art trigger mechanism (Curve 210) using essentially the same mainspring with same spring force, the present invention has a trigger pull force that is almost 3 pounds less than the most directly comparable prior art trigger mechanism. This lighter trigger action accompanying the lower maximum trigger pull force of the present trigger mechanism is attributable to the contoured shape of rear operating extension 51 of trigger 11 as described herein which minimizes the initial trigger stall or binding that plagues conventional trigger designs, and provides a more uniform, smooth trigger pull action throughout the trigger's entire range of motion while minimizing the peak or maximum pressure/force required to pull the trigger. In addition, based on FIG. 2, the trigger mechanism according to the present invention results in about a 20% reduction in the total work required by user to operate the trigger in comparison to the first prior art trigger mechanism represented by Curve 210.

In addition to having a lighter trigger pull, a trigger mechanism according to the present invention advantageously also provides smoother trigger operation than the prior art. This relates to the shape of the trigger force-pull curves. As shown in Curve 200 of FIG. 2, the present invention provides a trigger mechanism having a generally bell-shaped curve associated with a smooth trigger operation and gradual trigger pull force requirements, having the maximum trigger pull force occurring towards the middle portion of the curve with a gradual ramp up and ramp down trigger pull force-distance rate on each side of the maximum input force point. The shape of Curve 200 and gradual ramp up rate to maximum trigger pull force (near transition position of trigger mechanism shown in FIG. 14) is attributable to the contoured shape of rear operating extension 51 of trigger 11 as described herein. The gradual ramp down rate past the maximum trigger pull force (following transition position) is attributable to the contoured shape of sear 270 as described herein. When combined, in some embodiments, this provides smooth trigger operation over the entire range of the trigger motion. By contrast, prior art trigger mechanism Curves 210 and 220 are not bell shaped, and heavily biased in pull force magnitude towards the initial third of the trigger pull distance as shown. The maximum trigger pull force for Curves 210 and 220 occurs significantly earlier in the trigger pull sequence than in present Curve 200, not long after the initial trigger pull and tale up of slack in these trigger mechanisms (see sharp, nearly vertical increase in pull force between about 0.4 and 0.6 inches of trigger pull distance). It should also be noted that there is not much difference between the pull force required at 0.1 inches of trigger pull for both Curves 210 and 220 and their respective maximum trigger pull forces. The maximum trigger pull force also continues and remains almost steady (+/− a slight force variation) for about 0.2 inches of trigger pull for Curve 210 (between about 0.1 and 0.3 inches) and about 0.15 inches of trigger pull for Curve 220 (between about 0.1 and 0.2 inches). This creates a trigger pull force plateau for Curves 210 and 220, rather than a peak as shown in Curve 200 according to the present invention, so that the user must input nearly maximum trigger pull force for significantly longer period of time during a trigger pull than the present invention. The trigger pull force for both Curves 210 and 220 then drops off following the trigger force plateau towards the sear off point, and is especially abrupt for Curve 220. Accordingly, because of the almost constant input trigger force plateaus, the user will not be able to tactilely sense when the input force will suddenly begin to drop off during the trigger pull sequence. This may cause the revolver to jump or jerk momentarily as it is being discharged making it more difficult for some users to maintain precise aim on the intended target.

Based on the foregoing discussion of FIG. 2, it will be appreciated that the optimal trigger action benefits may be achieved by combining both the specially contoured trigger operating extension 51 and sear 270 according to the present invention. This results in both lower maximum trigger pull force requirements and smoother trigger operation as shown by the shape of Curve 200. However, the contoured trigger operating extension 51 may be used alone, which will still reduce the maximum trigger pull pressure and eliminate the trigger bind/stall problems during the initial trigger pull sequence of the prior art trigger mechanisms.

It will be noted that conventional trigger configurations, such as those exemplified by U.S. Pat. Nos. 3,628,278 and 4,307,530, have rear trigger operating extensions that engage the hammer dog with a top trigger contact surfaces that may be characterized as generally flat or horizontal, flat and angled downwards in a rear direction, or convex alone. In addition, the hammer dogs in conventional revolver configurations sometimes include sharp angled corners and are typically not rounded. When these conventional rear trigger operating extensions therefore make initial and subsequent contact with the end of the hammer dog through the full range of trigger motion, mutual contact surfaces on the hammer dog and trigger mate in a manner such that the normal applied surface forces exerted on each respective component do not act along ideal line of action $LOA_N$ or tangent to both rotational paths $P_T$, $P_H$ of the trigger and hammer in contrast to the embodiment of the present invention as shown in FIG. 6. This increases the frictional component of the contact forces between the hammer dog and trigger. Therefore, additional trigger force needs to be input by the user to overcome the higher contact sliding friction acting between the trigger and hammer surfaces than in a trigger configured and arranged according to the present invention. This, coupled with the mechanical advantage of the system typically being at a minimum at the start of the trigger pull motion, translates into higher trigger pull pressure requirements for the user and causes the temporary stalling or binding experienced in conventional revolvers during the initial trigger pull sequence until sufficient excess finger pressure is applied to the trigger by the user. The required applied finger pressure then abruptly decreases as shown in FIG. 2, resulting in the undesirable jerking trigger action which may adversely affect aiming the revolver.

Although the trigger mechanism of the present invention has been generally described with reference to embodiments of a hand-held revolver for convenience, it will be appreciated that the invention may be used with equal benefit in any type of firearm or weapon utilizing a cockable hammer and trigger mechanism to discharge the firearm, such as without limitation rifles. Accordingly, the invention is not limited in its applicability to revolvers and/or hand-held firearms alone.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

The invention claimed is:

1. A revolver with trigger mechanism comprising:

a frame;

a barrel supported by the frame and defining a bore;

at least one rotatable chamber aligned with the bore of barrel for holding a cartridge;

a hammer pivotally mounted in the frame and moveable between a forward uncocked position and a rearward cocked position;

a hammer dog pivotally coupled to the hammer for cocking the hammer; and a trigger pivotally mounted to the frame and operable to cock the hammer, the trigger including a concave camming surface configured and arranged to engage the hammer dog and cock the hammer in response to pulling the trigger wherein the hammer dog travels within the concave camming surface.

2. The revolver of claim 1, wherein the trigger further includes a convex camming surface being configured and arranged to engage the hammer in response to pulling the trigger.

3. The revolver of claim 2, wherein when the hammer is in the forward uncocked position, pulling the trigger first engages the concave camming surface with the hammer protrusion to move the hammer to a first cocked position and continuing to pull the trigger subsequently engages the convex camming surface with the hammer protrusion to move the hammer to a second cocked position.

4. The revolver of claim 1, wherein the hammer includes a rounded contact surface engageable with the concave camming surface of the trigger in response to pulling the trigger.

5. The revolver of claim 1, further comprising a mainspring biasing the hammer towards the uncocked position.

6. The revolver of claim 1, wherein the hammer further includes a sear having a contoured lower operating surface engageable with the trigger.

7. A revolver with trigger mechanism comprising:

a cylinder rotatably mounted in a frame and defining a plurality of chambers for holding cartridges;

a hammer pivotally mounted to the revolver and moveable between a forward uncocked position and a rearward cocked position;

a hammer dog coupled to the hammer for cocking the hammer; and a trigger pivotally mounted to the revolver and operable to cock the hammer, the trigger including a concave camming surface configured and arranged to engage the hammer dog, wherein the concave camming surface engages the hammer dog and cocks the hammer in response to pulling the trigger wherein the hammer dog travels within the concave camming surface.

8. The revolver of claim 7, wherein the concave camming surface is disposed on a rear operating extension extending rearwards from the trigger.

9. The revolver of claim 7, wherein the trigger further includes a convex camming surface disposed adjacent to the concave camming surface, the convex camming surface being configured and arranged to engage the hammer dog in response to pulling the trigger.

10. The revolver of claim 9, wherein when the trigger is pulled the hammer dog slides along the trigger from the concave camming surface to the convex camming surface.

11. The revolver of claim 7, wherein the hammer dog includes one end defining a rounded contact surface configured to engage the concave camming surfaces of the trigger.

12. The revolver of claim 7, wherein the trigger includes a hammer engaging ledge that engages a convex camming surface disposed on a lower operating surface of the hammer.

13. A revolver with trigger mechanism comprising:

a cylinder rotatably mounted in a frame and defining a plurality of chambers for holding cartridges;

a hammer pivotally mounted to the revolver and rotatable along a first arcuate path of motion between a rearward cocked position and a forward uncocked position;

a hammer dog coupled to the hammer and defining a contact surface; and a trigger pivotally mounted to the revolver and rotatable along a second arcuate path of motion, trigger including a concave camming surface that engages the contact surface of the hammer dog in response to pulling the trigger, wherein the concave camming surface of the trigger and the contact surface of the hammer dog are mutually configured and arranged such that the normal contact forces resulting between the trigger and hammer dog act in a line of action that is substantially tangent to both the first and second paths of motion during at least part of a sequence of pulling the trigger wherein the hammer dog travels within the concave camming surface.

14. The revolver of claim 13, wherein the trigger further includes a convex camming surface engageable with the contact surface of the hammer dog.

15. A method for cocking a hammer in a revolver comprising:

providing a firearm having a firing control mechanism including a pivotally mounted hammer and a trigger;

rotating the trigger;

moving a concave camming surface on the trigger towards the hammer;

engaging the concave camming surface with a hammer dog protrusion pivotally coupled to the hammer and extending outwards from the hammer; and cocking the hammer with the concave camming surface of the trigger wherein the hammer dog travels within the concave camming surface.

16. The method of claim 15, further comprising engaging a convex camming surface on the trigger with the protrusion in response to rotating the trigger.

17. The method of claim 15, further comprising applying a normal force with the concave camming surface on a protrusion extending outwards from the hammer that acts along a line of action that is tangent to both an arcuate path of motion defined by the hammer and an arcuate path of motion defined by the trigger.

18. The method of claim 15, wherein the cocking step includes first engaging the concave camming surface with a protrusion extending outwards from the hammer and subsequently engaging a convex camming surface on the trigger with the protrusion.

19. The method of claim 15, further comprising engaging a convex camming surface formed on a lower surface of the hammer with a hammer engaging ledge formed on the trigger.

20. A revolver with trigger mechanism comprising:

a cylinder rotatably mounted in a frame and defining a plurality of chambers for holding cartridges;

a hammer pivotally mounted to the revolver and moveable between a forward uncocked position and a rearward cocked position;

a hammer dog coupled to the hammer for cocking the hammer;

a trigger pivotally mounted to the revolver and operable to cock the hammer, the trigger including a concave camming surface configured and arranged to engage the hammer dog; and a sear defined by a portion of the hammer and having a contoured lower operating surface engageable with the trigger;

wherein rotating the trigger to a first position engages the concave camming surface with the hammer dog and partially cocks the hammer wherein the hammer dog travels within the concave camming surface.

21. The revolver of claim 20, wherein the contoured lower operating surface of the sear includes a convex camming surface engageable with the trigger.

22. The revolver of claim 21, wherein the contoured lower operating surface of the sear further includes a concave camming surface.

23. The revolver of claim 20, wherein the trigger further includes a convex camming surface disposed adjacent to the concave camming surface of the trigger, the convex camming surface of the trigger being configured and arranged on the trigger to engage the hammer dog.

24. The revolver of claim 20, wherein rotating the trigger to a second position engages a convex camming surface disposed on the trigger with the hammer dog and further cocks the hammer.

25. The revolver of claim 20, wherein rotating the trigger to the second position simultaneously engages a convex camming surface on the lower operating surface of the sear with the trigger.

26. The revolver of claim 20, wherein the trigger includes a hammer engaging ledge spaced apart from the concave camming surface of the trigger, the hammer engaging ledge operable to engage the contoured lower operating surface of the sear when the trigger is rotated to a second position.

* * * * *